US007751579B2

(12) United States Patent
Schulein et al.

(10) Patent No.: US 7,751,579 B2
(45) Date of Patent: Jul. 6, 2010

(54) ACOUSTICALLY TRANSPARENT DEBRIS BARRIER FOR AUDIO TRANSDUCERS

(75) Inventors: Robert B. Schulein, Schaumburg, IL (US); John S. French, Arlington Heights, IL (US)

(73) Assignee: Etymotic Research, Inc., Elk Grove Village, IL (US)

( * ) Notice: Subject to any disclaimer, the term of this patent is extended or adjusted under 35 U.S.C. 154(b) by 1504 days.

(21) Appl. No.: 10/866,233

(22) Filed: Jun. 10, 2004

(65) Prior Publication Data

US 2005/0018866 A1 Jan. 27, 2005

Related U.S. Application Data

(60) Provisional application No. 60/478,271, filed on Jun. 13, 2003.

(51) Int. Cl.
*H04R 25/00* (2006.01)

(52) U.S. Cl. ..... 381/325; 381/322; 381/324; 381/328; 181/129; 181/130; 181/135

(58) Field of Classification Search ..... 381/72, 381/150, 325, 189, 328, 380, 322, 324; 181/167, 181/129, 130, 135
See application file for complete search history.

(56) References Cited

U.S. PATENT DOCUMENTS

| | | | |
|---|---|---|---|
| 2,487,038 | A | 11/1949 | Baum |
| 2,966,558 | A | 12/1960 | Knowles |
| 3,002,058 | A | 9/1961 | Knowles |
| 3,080,011 | A | 3/1963 | Henderson |
| 3,111,563 | A | 11/1963 | Carlson |
| 3,169,171 | A | 2/1965 | Wachs et al. |
| 3,177,412 | A | 4/1965 | Carlson |
| 3,251,954 | A | 5/1966 | Carlson |
| 3,560,667 | A | 2/1971 | Carlson |
| 3,740,496 | A | 6/1973 | Carlson et al |
| 3,770,911 | A | 11/1973 | Knowles et al |
| 3,783,202 | A | 1/1974 | Bobb |
| 3,835,263 | A | 9/1974 | Killion |
| 4,071,040 | A | 1/1978 | Moriarty |
| 4,424,419 | A | 1/1984 | Chaput et al. |
| 4,450,930 | A | 5/1984 | Killion |

(Continued)

FOREIGN PATENT DOCUMENTS

| | | |
|---|---|---|
| AU | 199941282 | 6/1999 |

(Continued)

OTHER PUBLICATIONS

Title "Parylene-Diaphragm Piezoelectric Acoustic Transducers" Author: Cheol-Hyun Han et al. 2000 IEEE.*

(Continued)

*Primary Examiner*—Vivian Chin
*Assistant Examiner*—Fatimat O Olaniran
(74) *Attorney, Agent, or Firm*—McAndrews, Held & Malloy, Ltd.

(57) ABSTRACT

The present invention relates to systems and methods for protecting acoustic devices. In particular embodiments, barriers are useful for preventing a variety of solid, liquid, and vapor contaminants from modifiying or damaging the performance of acoustic transducers, while at the same time providing essentially an acoustically transparent passage of sound.

46 Claims, 28 Drawing Sheets

U.S. PATENT DOCUMENTS

| | | | | | |
|---|---|---|---|---|---|
| 4,472,887 | A | | 9/1984 | Avedian et al. | |
| 4,553,627 | A | | 11/1985 | Gastmeier et al. | |
| 4,730,283 | A | | 3/1988 | Carlson et al. | |
| 4,742,887 | A | | 5/1988 | Yamagishi | |
| 4,870,688 | A | | 9/1989 | Voroba et al. | |
| 4,875,546 | A | | 10/1989 | Krnan | |
| 4,953,215 | A | | 8/1990 | Weiss et al. | |
| 4,987,597 | A | | 1/1991 | Haertl | |
| 5,092,424 | A | | 3/1992 | Schreiber et al. | |
| 5,201,007 | A | | 4/1993 | Ward et al. | |
| 5,278,360 | A | | 1/1994 | Carbe et al. | |
| 5,401,920 | A | * | 3/1995 | Oliveira | 181/135 |
| 5,470,797 | A | | 11/1995 | Mastrangelo | |
| 5,701,348 | A | | 12/1997 | Shennib et al. | |
| 5,748,743 | A | | 5/1998 | Weeks | |
| 5,828,012 | A | * | 10/1998 | Repolle et al. | 181/175 |
| 5,881,159 | A | | 3/1999 | Aceti et al. | |
| 5,920,636 | A | | 7/1999 | Oliveira et al. | |
| 6,000,492 | A | * | 12/1999 | Puthuff et al. | 181/135 |
| 6,014,347 | A | | 1/2000 | Mignot et al. | |
| 6,105,713 | A | | 8/2000 | Brimhall et al. | |
| 6,134,333 | A | | 10/2000 | Flagler | |
| 6,148,953 | A | * | 11/2000 | Fujitani | 181/169 |
| 6,164,409 | A | * | 12/2000 | Berger | 181/135 |
| 6,169,811 | B1 | | 1/2001 | Croft, III | |
| 6,205,227 | B1 | | 3/2001 | Mahoney et al. | |
| 6,349,790 | B1 | | 2/2002 | Brimhall | |
| 6,359,993 | B2 | | 3/2002 | Brimhall | |
| 6,389,146 | B1 | | 5/2002 | Croft, III | |
| 6,473,513 | B1 | | 10/2002 | Shennib et al. | |
| 6,505,076 | B1 | | 1/2003 | Tziviskos et al. | |
| 6,512,834 | B1 | | 1/2003 | Banter et al. | |
| 6,546,110 | B1 | | 4/2003 | Vonlanthen | |
| 6,549,634 | B1 | | 4/2003 | Vonlanthen | |
| 6,731,770 | B1 | | 5/2004 | Vonlanthen | |
| 6,744,897 | B1 | | 6/2004 | Vonlanthen | |
| 6,795,562 | B1 | * | 9/2004 | Gunnersen et al. | 381/325 |
| 6,813,364 | B1 | | 11/2004 | Vonlanthen | |
| 6,831,988 | B2 | | 12/2004 | Vonlanthen | |
| 6,857,501 | B1 | * | 2/2005 | Han et al. | 181/158 |
| 6,879,696 | B1 | * | 4/2005 | Vonlanthen | 381/322 |
| 7,020,299 | B2 | * | 3/2006 | Niederdrank | 381/370 |
| 2002/0106096 | A1 | | 8/2002 | Vonlanthen | |
| 2002/0177883 | A1 | | 11/2002 | Tziviskos et al. | |
| 2003/0156727 | A1 | | 8/2003 | Vonlanthen | |
| 2003/0219138 | A1 | | 11/2003 | Vonlanthen | |
| 2004/0151331 | A1 | | 8/2004 | Vonlanthen | |
| 2005/0002540 | A1 | | 1/2005 | Vonlanthen | |
| 2005/0254673 | A1 | * | 11/2005 | Hsieh et al. | 381/175 |

FOREIGN PATENT DOCUMENTS

| | | |
|---|---|---|
| AU | 200010255 | 11/1999 |
| AU | 200047401 | 6/2000 |
| AU | 2003203808 | 4/2003 |
| CA | 2388321 | 12/1999 |
| CA | 2340725 | 12/2000 |
| CA | 2375864 | 12/2000 |
| CA | 2375871 | 12/2000 |
| CA | 2412476 | 12/2002 |
| CA | 2427783 | 11/2003 |
| CN | 1196377 | 10/1998 |
| CN | 1357215 | 7/2002 |
| CN | 1367991 | 9/2002 |
| DE | 2818273 | 11/1979 |
| DE | 59906279 | 8/2003 |
| DE | 50010852 | 9/2005 |
| EP | 0540862 | 7/1996 |
| EP | 0835042 | 4/1998 |
| EP | 1228666 | 7/2003 |
| EP | 1 341 395 | 9/2003 |
| EP | 1 287 721 | 7/2005 |
| JP | 2003502966 | 1/2003 |
| JP | 2003502967 | 1/2003 |
| JP | 2003519938 | 6/2003 |
| JP | 2004500734 | 1/2004 |
| WO | WO9939548 | 8/1999 |
| WO | WO9966779 | 12/1999 |
| WO | WO0027166 | 5/2000 |
| WO | WO0048443 | 8/2000 |
| WO | WO0079832 | 12/2000 |
| WO | WO0079834 | 12/2000 |
| WO | WO0079835 | 12/2000 |
| WO | WO0079836 | 12/2000 |
| WO | WO 00/48443 | 8/2001 |

OTHER PUBLICATIONS

Title, "A Micromachined Thin-Film Teflon Electret Microphone", Author: Wen H. Hsieh et al. 1997 International Conference on Solid-State Sensors and Actuators IEEE 1997.*

Title "Parylene-Diaphragm Piezoelectric Acoustic Transducers" Author: Cheol-Hyun Han et al. 2000 IEEE.* itle, "A Micromachined Thin-Film Teflon Electret Microphone", Author: Wen H. Hsieh et al. 1997 International Conference on Solid-State Sensors and Actuators IEEE 1997.*

Kochkin, Sergei, "Consumers Rate Improvements Sought in Hearing Instruments—What do hearing instrument users want from us and our products?" The Hearing Review, Nov. 2002 .

Kirkwood, David, "How are we doing? Thanks to MarkeTrak, we know," The Hearing Journal, 2005.

Knowles, Active Wax Protection System MicroWaxBuster(r). No date given.

Knowles Advance Information Release for WaxShield. No date given.

* cited by examiner

ER 4 3-FLANGE TIPS WITH REFINED POLYETHYLENE FILM

EQUIVALENT ANALOG CIRCUIT FOR RECEIVER BARRIER

EQUIVALENT ANALOG CIRCUIT FOR MICROPHONE BARI ER

ACOUSTICALLY TRANSPARENT DEBRIS BARRIER FOR AUDIO TRANSDUCERS

CROSS-REFERENCE TO RELATED APPLICATIONS/INCORPORATION BY REFERENCE

This application is based on and claims priority from provisional application Ser. No. 60/478,271, "Acoustically Transparent Debris Barrier for Audio Transducers", filed Jun. 13, 2003, the complete subject matter of which is incorporated herein by reference in its entirety.

FEDERALLY SPONSORED RESEARCH OR DEVELOPMENT

[N/A]

MICROFICHE/COPYRIGHT REFERENCE

[N/A]

BACKGROUND OF THE INVENTION

Aspects of the present invention relate to debris barriers. More specifically, aspects of the present invention relate to debris barriers for audio transducers. In particular this invention relates to barrier membranes useful for preventing a variety of solid, liquid, and vapor contaminants from modifidying or damaging the performance of the acoustic transducers, while at the same time providing essentially an acoustically transparent passage of sound. Applications include the protection of small microphones and receivers (speakers for example) commonly used in applications including hearing aids, hearing protection, communications equipment, personal entertainment devices and performance sound monitoring equipment.

Hearing device technology has progressed rapidly in recent years. First generation hearing devices were primarily of the Behind-The-Ear (BTE) type, where an externally mounted device was connected by an acoustic tube to a molded shell placed within the ear. With the advancement of component miniaturization, modern hearing devices are focusing primarily on one of several forms of In-The-Ear or ITE devices. Three main types of ITE devices are routinely offered by audiologists and hearing instrument specialists. Full shell ITE devices rest primarily in the concha of the ear and have the disadvantages of being fairly conspicuous to a bystander and relatively bulky to wear. Smaller ITE devices fit further in the ear canal and are commonly referred to as In-The-Canal (alternatively referred to as "ITC") devices. Such hearing aids fit partially in the concha and partially in the ear canal and are less visible but still leave a substantial portion of the hearing device exposed. Recently, Completely-In-The-Canal (alternatively referred to as "CIC") hearing devices have come into greater use. As the name implicates, these devices fit in the ear canal and are essentially hidden from view from the outside.

In addition to the obvious cosmetic advantages these types of transducers or in-the-canal devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

One common problem associated with the microphones and recievers used in these and other electroacostic devices used in and around the human ear is the infusion of debris of various forms, causing the transducers to perform poorly and in some cases fail to function. Perhaps the most common forms of debris are referred to as Cerumen or ear wax, which is noted to appear in solid, liquid and vapor forms. It has long been a desire to develop sufficient barriers for such debris that are transparent to sound, durable, and easy to clean. In addition to ear wax, other forms of debris such as sweat, water, and hair spray for example often cause similar problems.

Numerous devices have been developed in an effort to solve such problems. Such devices generally include passive and active mechanical solutions that impede the flow of debris, providing a means to capture some portion of the accumulated debris.

Known passive and active mechanical solutions impede the flow of debris, providing a means to capture some portion of the accumulated debris and provide a direct path for desired sounds to pass through the barrier. Examples of such known solutions include U.S. Pat. No. 4,553,627 to Gastmeier et al.; U.S. Pat. No. 4,953,215 to Hans-Joachim Weiss et al.; U.S. Pat. No. 5,278,360 to Carbe, and U.S. Pat. Nos. 6,105,713; and 6,349,790 to Brimhall et al, each of which are incorporated herein by reference in their entirety. Such devices are adapted to trap solid and semi-solid debris while letting liquid and vapor forms pass through. Such devices are often difficult to clean due to small openings or passages in their design. In addition it is often difficult to determine that these disclosed devices are filled with debris.

Some known disposable, passive mechanical solutions use open cell foam type materials to capture debris, while allowing desireable sound to pass through. Examples of such known disposable passive mechanical solutions include, for example, U.S. Pat. Nos. 5,401,920 and 5,920,636 to Oliveira et al. The disclosed devices are disposable, not cleanable and may capture solid and liquid debris but would have difficulty capturing vapor debris.

It is also known that passive devices may make use of semi-rigid microporous membranes (Microporous PTFE for example) adapted to trap debris and enable some sound to pass. Examples of such membranes include U.S. patent application No. 2002/0177883 to Tziviskos et al; U.S. Pat. No. 6,505,076 to Tziviskos et al; U.S. Pat. No. 6,512,834 to Banter et al; U.S. Pat. No. 6,134,333 to Flagler; U.S. Pat. No. 5,828,012 to Repollé et al; U.S. Pat. No. 4,987,597 to Haertl; and U.S. Pat. No. 4,071,040 to Moriarty, each of which is incorporated herein by reference in their entity. These devices appear to be effective for some applications but are known to limit the frequency response of the corresponding transducer due to their relatively high acoustic impedance. These devices are generally limited to speech bandwidth transmission, and will eventualy plug up due to solid and liquid debris accumulations, hence requiring replacement. Due to the porosity of such devices, debris in the form of vapor are allowed to pass through.

Other known passive devices place a non-porous membrane between an acoustic transducer and the offending source of debris, where the non-porous membrane tends to act as a barrier to all forms of debris, and to varying degrees let sound effectively pass through. Early examples of such barriers are described in U.S. Patent No. 3,169,171 to Wachs et al. and U.S. Patent No. 4,424,419 to Chaput each of which are incorporated herein by reference in their entirety. Such barriers are generally used in speech bandwidth applications, restricted in performance between about 10 Hz to about 4 kHz. The Wachs patent discloses a cap (or protective barrier)

which is made of flexible thin paper, or plastic material such as sheet vinyl, polyethylene or the like. No details are provided as to the acctual acoustical performance of this device, but it appears to have restricted frequency range. In the Chaput patent, the described membrane is fabricated from 10 μm Mylar on to which Aluminum had been vacuum deposited.

In U.S. Patent No. 5,748,743 to Weeks, incorporated herein by reference in its entirety, describes a two piece hearing aid, one piece of which provides a barrier to ear wax using an integral membrane that is described to be "as thin as possible in order to minimize attenuation of the amplified sound from the micro speaker in the hearing aid device to the user's ear drum. Weeks indicates that the membrane must be less than 0.010" thick and ideal performance occurs with membranes below 0.001" thick." However, the Weeks Patent does not disclose important information regarding membrane characteristics, such as membrane dimensions, membrane physical and chemical properties, and resulting barrier performance characteristics.

U.S. Pat. No. 6,164,409 to Berger detailed mechanical specifications for a membrane used with hearing aids. However, the Berger patent does not provide sufficient measurement data to demonstrate performance in two particular areas: low and high frequency response; distortion and attenuation properties of the device. The Berger Patent only discloses frequency response data between 400 and 4 kHz, which primarily covers the speech communications range. The suitability of the performance of the described device is questionable from the vantage point of acceptable acoustical attenuation. In addition, various embodiments of the device disclosed by Berger feature "a rigid, non-porous, non-sound permeable vibratable membrane". It should be appreciated that the disclosed membrane structure has a high density, thickness and stiffness making it to rigid to move effectively for use with small transducers used in ear applications. Such membranes will result in unacceptable attenuation and distortion of sound passage for these types of applications. Furthermore, the disclosed membrane has a diameter between about 0.375" to about 0.20" (about 9.53 mm to about 5.09 mm) which would appear to have little practical value in hearing aid applications due to large size.

Other known attempts to provide non-porous barriers used with hearing aids have failed due to distortion or barrier deterorization. For example, a barrier introduced Knowles Electronics in 1994 called the "WaxShield" became unusable when exposed to oils in the ear, as well as demonstrating unacceptable distortion. In addition, similar devices from major hearing aid devices such as Siemens and Phonak were never introduced into production apparently due to distortion and/or frequency response problems when fabricated with dimensions suitable for hearing aid applications.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

In particular this invention relates to barrier membranes useful for preventing a variety of solid, liquid, and vapor contaminants from modifiying or damaging the performance of the acoustic transducers, while at the same time providing essentially an acoustically transparent passage of sound. Applications include the protection of small microphones and receivers (speakers for example) commonly used in applications including hearing aids, hearing protection devices, communication equipment, personal entertainment devices and performance sound monitoring equipment.

One embodiment of the invention comprises a barrier used with an acoustic device that is substantially acoustically transparent to sound. At least one embodiment comprises a non-rigid, non-tensioned film having a thickness of about 0.0003 inches or less (0.00015 or less for example) and formed of a non-porous material capable of being formed into a highly compliant sealing structure.

Embodiments of the barrier comprise a film that is less than about 0.00015 inches thick, has a diameter of about 3.00 mm or less (2.75 mm or less for example); and an active compliant area of about 2.5 mm or greater. In at least one embodiment, the material that comprises the film has a low mass, a low stiffness, is chemically resistant and a low sensitivity to temperature change. Further, the material has properties of high elongation and high impact strength. In at least one embodiment, the material comprises a polyethylene blend, where the polyethylene blend comprises at least an organometallic complex such as hexane or metalocine.

At least one embodiment of the invention comprises a barrier used with an acoustic device that is substantially acoustically transparent to sound. Embodiments of the barrier further comprise a film that is less than about 0.0003 inches thick, has a diameter of about 3.00 mm or less (2.75 mm or less for example); and an active compliant area of about 2.5 mm or greater. In at least one embodiment, the material that comprises the film has a low mass, a low stiffness, is chemically resistant and a low sensitivity to temperature change. Further, the material has a high elongation and high impact strength. In at least one embodiment, the material comprises a polyethylene blend, where the polyethylene blend comprises at least an organometallic complex such as hexane or metalocine.

Still another embodiment of the invention comprises a communication device adapted to block debris. In at least one embodiment, the device comprises an acoustic device; and a non-rigid, non-tensioned, membrane-like barrier removably coupled to the acoustic device. In at least one embodiment, barrier comprises a non-porous material about 0.0003 inches thick or less (for example 0.00015 or less) having a diameter of about 2.75 mm or less; and an active compliant area of about 2.5 mm or greater.

In at least one embodiment, the material that comprises the film has a low mass, a low stiffness, is chemically resistant and a low sensitivity to temperature change. Further, the material has a high elongation and high impact strength. In at least one embodiment, the material comprises a polyethylene blend, where the polyethylene blend comprises at least an organometallic complex such as hexane or metalocine.

Yet another embodiment of the present invention comprise a method of protecting an acoustic device from debris. This embodiment comprises forming a barrier and affixing the barrier to an attachment device adapted to be removably used with the acoustic device. In at least one embodiment, the barrier is substantially acoustically transparent to sound comprising a non-rigid, non-tensioned film having a thickness of about 0.0003 inches or less, the film being formed of a non-porous material capable of being formed into a highly compliant sealing structure.

One other embodiment comprises a method of forming an acoustic device having a debris barrier. Embodiments of the method comprises forming a thin low mass, low stiffness and compliant film and preparing the acoustic device. The film is affixed to the acoustic device forming the debris barrier. Yet another embodiment of the invention comprises a barrier used with an acoustic device. This embodiment comprises a non-porous film that is substantially acoustically transparent to sound having a maximum attenuation of approximately 2 dB or less over a frequency range of approximately 100 Hz to 10,000 Hz and adds less than 0.5% THD for sound pressure levels up to about 115 dB SPL. In one or more embodiments, the film is chemically resistant; has a high elongation and high impact strength, a thickness of about 0.0003 inches or less, and a diameter of about 3.0 mm or less.

These and other advantages, aspects, and novel features of the present invention, as well as details of illustrated embodiments, thereof, will be more fully understood from the following description and drawings.

DETAILED DESCRIPTION OF THE INVENTION

Figure 1:
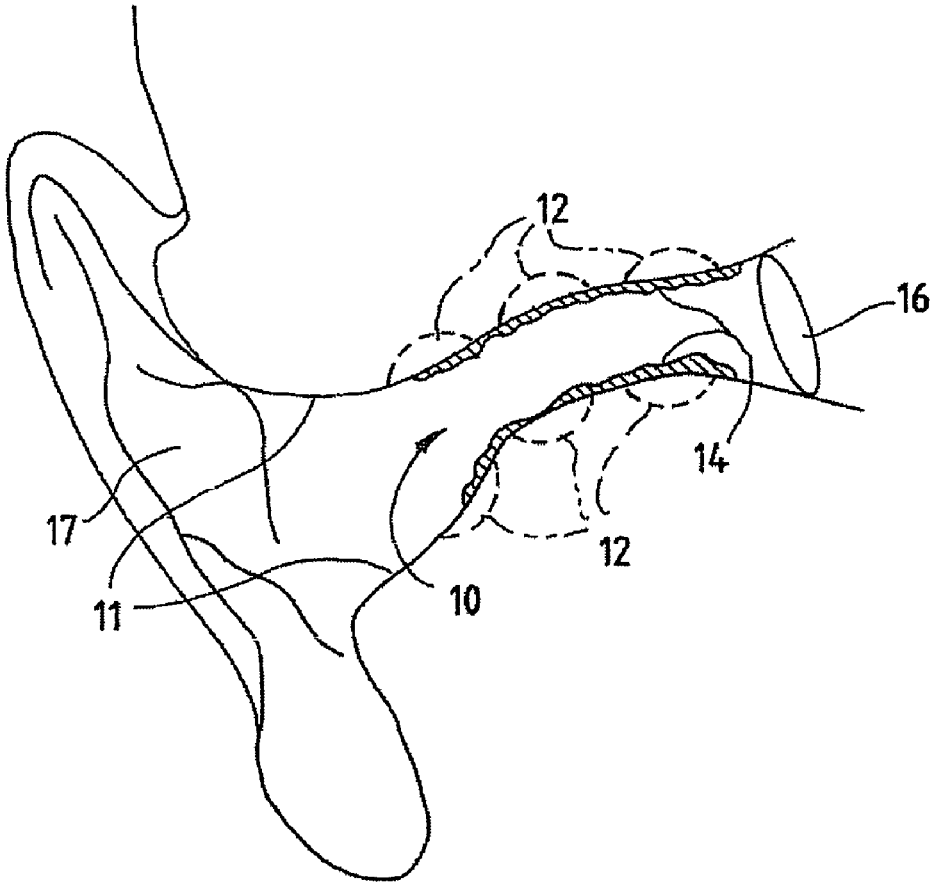
FIG. 1 illustrates a cut away section of an ear canal and its associated anatomy.

Particular embodiments of the present invention relate to barrier membranes useful for preventing a variety of solid, liquid, and vapor contaminants from modifidying or damaging the performance of acoustic transducers, while at the same time providing essentially an acoustically transparent passage of sound. Applications include the protection of small microphones and receivers (speakers for example) (generally referred to as acoustic devices") commonly used in applications including hearing aids, hearing protection attenuators, communications equipment and personal entertainment and performance sound monitoring devices (generally referred to as "equipment").

Based on the clear and unmet needs of the hearing aid and similar sound application users, there appears to be a need for a suitably rugged, cleanable, and acoustically transparent barrier used with both receivers (speakers for example) and microphones. In at least one embodiment, the present invention comprises a barrier adapted to protect acoustic devices from various solid, liquid and vapor contaminants used in a variety of hearing, hearing protection, entertainment and communication applications.

In at least one embodiment, the barrier is applied or affixed to the acoustic device (using any suitable mechanical, adhesive and/or heat bonding process for example). The barrier is substantially acoustically transparent to sound and comprises a non-rigid, non-tensioned film, formed of a non-porous material, having a thickness of about 0.0003 inches or less (about 0.00015 inches thick for example), a diameter of about 2.75 mm or less and an active compliant diameter area of about 2.5 mm or greater.

In at least one embodiment, the barrier material is comprised of a low mass and has low stiffness, a high elongation and high impact strength. The barrier material is comprised of a polyethylene blend (an organmetallic complex comprising hexane or metalocine for example) that is chemically resistant to solid, liquid and vapor contaminants and is insensitive to temperature change (in an expected operating range for example).

It should be appreciated that, in at least one embodiment, the barrier prevents all forms of cerumen (i.e., solid, liquid and vapor) from contaminating the acoustic device without affecting the sound quality or fit of the device. Embodiments of the invention would enable the user to easily detect the presence of cerumen, would be easy to clean and replace, and would require minimal modification of the hearing aid manufacturer's assembly process.

Yet another embodiment of the invention comprises a barrier used with an acoustic device. This embodiment comprises a non-porous film that is substantially acoustically transparent to sound having a maximum attenuation of approximately 2 dB or less over a frequency range of approximately 100 Hz to 10,000 Hz and adds less than 0.5% THD for sound pressure levels up to about 115 dB SPL. In one or more embodiments, the film is chemically resistant; has a high elongation and high impact strength, a thickness of about 0.0003 inches or less, and a diameter of about 3.0 mm or less.

FIG. 1 illustrates the general anatomy of an ear. Generally, the ear includes a canal 10 with fleshy walls 11, ceruminous glands 12, a tympanic membrane 16 (ear drum) and a concha 17. The tympanic membrane 16 is located at the deepest portion of the ear canal, and transmits acoustic energy into the inner ear where it is eventually interpreted by the brain as sounds.

The Ceruminous glands 12 secrete solid, liquid and vapor contaminants 14 (alternatively referred to as Cerumen or ear wax), which accumulates within the ear canal 10 and, most particularly, along the fleshly walls 11. Contaminant 14 naturally propagates outward from the inner portions of the ear canal 10 towards the concha 17. This outward movement is due in part to the action of tiny cilia (not shown) located along the ear canal walls 11 and in part to the natural movements of the ear canal 10.

Based on clear and unmet needs of hearing aid and similar sound application users, there appears to be a need for a suitably rugged, cleanable and acoustically transparent barrier for both receivers (speakers for example) and microphones. In one embodiment, the present invention comprises a non-rigid, non-tensioned, membrane-like barrier adapted to protect acoustic transducers or devices from various solid, liquid and vapor contaminants (where the acoustic device having a barrier applied or affixed thereto is referred to as a "communication device"), adapted for use in a variety of hearing, hearing protection, entertainment and communications applications.

In one embodiment, the barrier comprises a thin, low mass, low stiffness and highly compliant membrane adapted to seal the sound inlet or outlets of the acoustic devices (transducers such as microphones and speakers or receivers for example). The membrane may be made from materials such as a Polyethylene and Teflon PTFE films, selected and processed to have a predetermined thickness, shape, compliance and attachment means for specific applications. Such barriers are used to prevent the intrusion of earwax and other debris in solid, liquid, or vapor form, capable of damaging or impairing the proper operation of sound transducers. Common applications include hearing aids, hearing protection devices, communications equipment and personal entertainment and monitoring devices. The barriers are implemented proximate to the acoustical inlet or outlet of such transducers, so as to allow both the recognition of the presence of contaminants, and convenient cleaning with common solvents and cleaning devices (for example, water, saliva, alcohol, hydrogen peroxide).

Based on numerous measurements of the acoustic transmission characteristics of such concepts, it is contemplated that the membrane should be highly compliant and therefore non-rigid. In order for sound to appear to "pass through" the membrane, the membrane must move freely so as to allow re-radiation of the sound. Such motion is created by the excitation sound field. If the impedance of the moving diaphragm is relatively small compared to that of the acoustic load that it is attempting to drive, then the amount of attenuation will be negligible.

It is contemplated that, in one embodiment, a barrier is constructed from a material approximately 0.00015 inches thick that is very limp when it has been stretched from an initial thickness approximately twice this value. Once stretched the material assumes a wrinkled state and is generally applied in such a condition so as to form a highly compliant relaxed and non-tensioned diaphragm (having a low impedance).

It is further contemplated that the re-radiating area of the film barrier should be sufficiently large so as to avoid distortion problems. As a specific example, the port exit diameter for three flanged ear tips provided below had to be increased from approximately 1 mm to 3 mm in diameter to reduce the resultant diaphragm motion and hence perceived distortion.

Further, the film barrier should be relatively inert and non-damaging to humans. The barrier material must be suitably strong (and easily cleaned of accumulated debris) and resist rupture in typical applications. It is contemplated that Polyethylene and Teflon, among other materials, have such properties.

FIGS. 2A-2G illustrate an example of an acoustic device and an acoustically transparent barrier applied to such acoustic device forming a communication device. In particular, one embodiment comprises an acoustically transparent barrier used with an acoustic device (ear tips for example) in a accordance with one embodiment of the present invention.

Figure 2A:
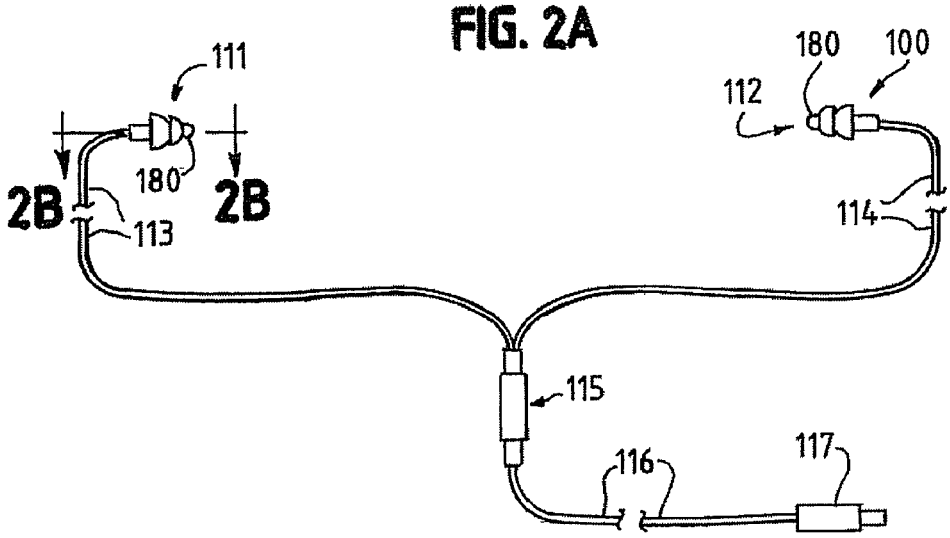
FIG. 2A illustrates an example of an acoustic device (a high fidelity insert earphone assembly for example) used in accordance with one embodiment of invention.

In FIG. 2A, reference numeral 100 generally designates an earphone assembly or ear tips which is constructed in accordance with the principles of this invention and which is suitable for use by an audiophile, for example. It will be understood, however, that a number of features of the invention are not limited to any particular use. Certain features may be used, for example, in the construction of hearing aids for use by persons having a hearing impairment.

The illustrated assembly 100 includes a pair of earphones 111 and 112 (each earphone 111 and 112 having tip 180) for insertion into the entrances of the ear canals of a user. A pair of cables 113 and 114 connect earphones 111 and 112 to a junction unit 115. Common cable 116 connects the junction unit 115 to a plug connector 117 which may be connected to an output jack of a stereophonic amplifier, for example.

Figure 2B:
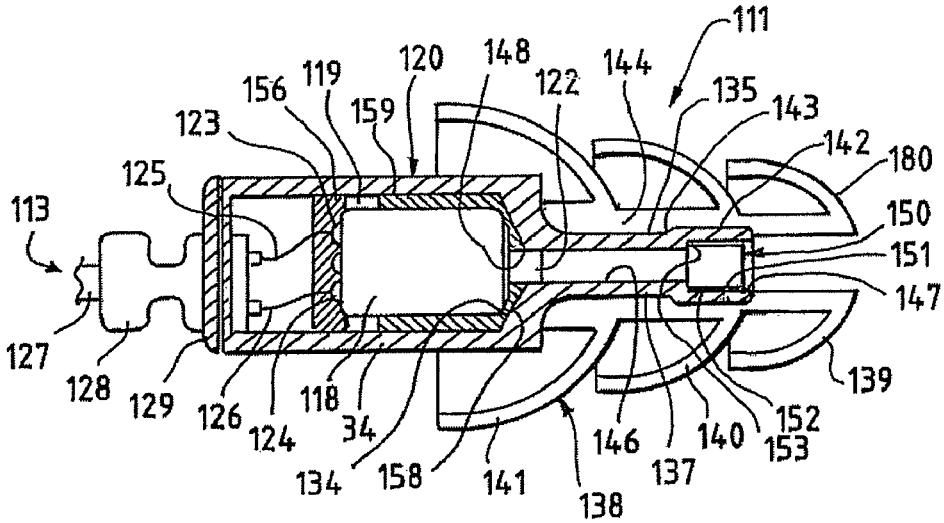
FIG. 2B illustrates a cross-sectional view of one earphone of the assembly of FIG. 2A, taken substantially along line 2-2 of FIG. 2A.

FIG. 2B depicts a cross-sectional view of the earphone 111, the construction of the other earphone 112 being preferably identical to that of the earphone 111. The earphone 111 comprises a receiver 118 which is mounted in a chamber portion 119 of a housing member 120. The receiver 118 has an acoustic output port and electrical input terminals 123 and 124 and is operative for generating an acoustic output signal at the output port 122 as a function of an electrical signal applied to the terminals 123 and 124. The terminals 123 and 124 are connected through wires 125 and 126 to conductors of the cable 113 and an outer sheath 127 of the cable 113 is bonded to a strain relief member 128. Member 128 is secured in an opening of an end cap 129 which is secured to one end of the housing member 120 to close one end of the chamber portion 119.

The housing member 120 includes a wall 132 at an opposite end of the chamber portion 119 and an outer wall 134 of the chamber portion 119 which is in surrounding relation to the receiver 118 and which may preferably be of generally cylindrical form.

The housing member 120 further includes a tubular portion 135 which projects from the end wall 132 of the chamber portion of the housing member and which is inserted in an opening 137 of an acoustic coupling device 138 arranged to be inserted into the entrance of an ear canal of a user. As shown, the coupling device 138 is in the form of an ear tip of a soft compliant material and has three outwardly projecting flange portions 139, 140 and 141 which are of generally conical form and of progressively increasing diameters, arranged to conform to the inner surface portions of the entrance of the ear canal of the user and to provide a seal limiting transmission of sound to the ear canal.

Custom ear molds or other types of coupling devices may be substituted for the illustrated device 138, the subassembly of the housing member 120, receiver 118 and other parts being thus usable with various types of coupling devices.

With the construction as thus far described, the housing member 120 may be readily molded from plastic in one piece and it serves the functions of connecting to the outlet port of the receiver, supporting the damper, providing a sound passage and releasably connecting to a coupling device which may be of various possible types, such functions being performed with a high degree of accuracy and reliability.

Figure 2C:
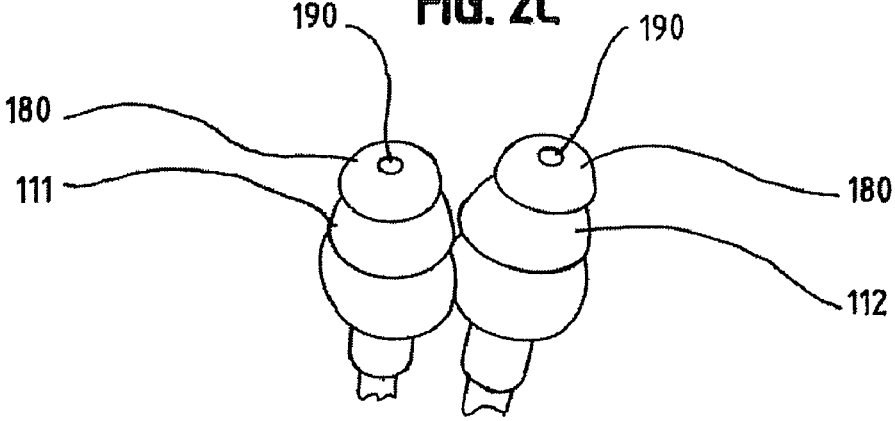
FIG. 2C illustrates an acoustically transparent barrier applied to the ear tips used with an earphone of the assembly similar to that illustrated in FIGS. 2A and 2B in accordance with one embodiment of the present invention.
Figure 2D:
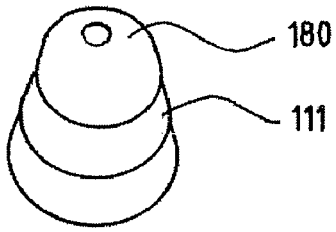
FIG. 2D illustrates one example of an ear tip prior to applying an acoustically transparent barrier in accordance with one embodiment of the present invention.
Figure 2E:
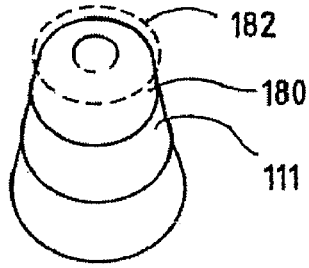
FIG. 2E illustrates one example of a modified ear tip prior to accepting an acoustically transparent barrier in accordance with one embodiment of the present invention.

FIG. 2C illustrates an acoustically transparent barrier 190 applied to ear tips 180 used with high fidelity insert earphones 111 and 112 for example. FIG. 2D illustrates one example of an ear tip 180 similar to that illustrated in FIG. 2C prior to applying an acoustically transparent barrier. FIG. 2E illustrates one example of a modified ear tip 180 prior to accepting an acoustically transparent barrier 190. In one embodiment, the sound exit (illustrated in FIG. 2E by a dotted line 182) is enlarged from about 1 mm to about 3 mm in diameter, increasing the sound re-radiation area.

Figure 2F:
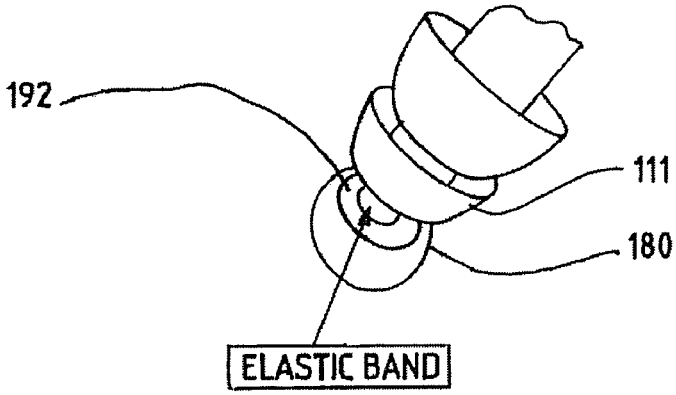
FIG. 2F illustrates one example of a mechanical device used to secure an acoustically transparent barrier to an ear tip for example in accordance with one embodiment of the present invention.
Figure 2G:
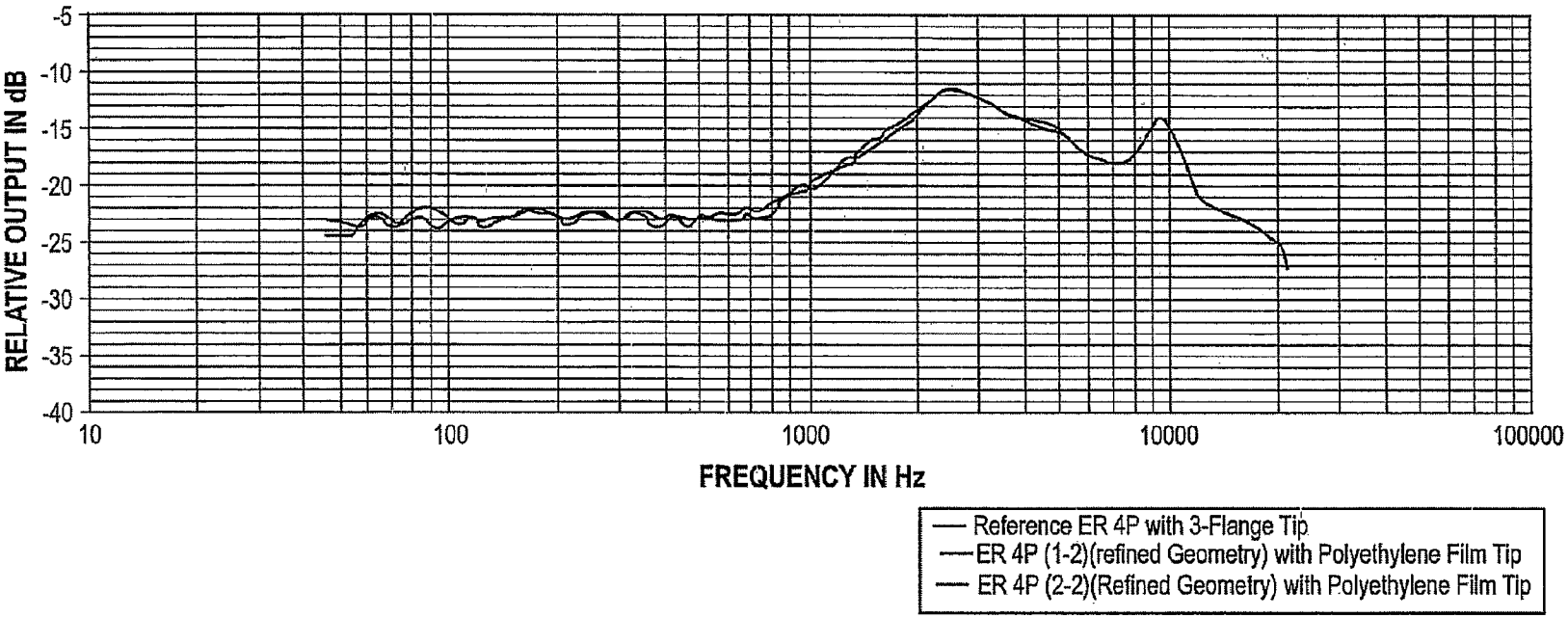
FIG. 2G depicts a graph illustrating frequency response analysis data of the ear tips of FIGS. 2A-2F showing the negligible influence of the barrier on attenuation and frequency response in accordance with one embodiment of the present invention.

FIG. 2F illustrates one example of a mechanical device 192 (an elastic band for example) used to secure the acoustically transparent barrier 190 to an ear tip for example. Although a mechanical device 192 is discussed, any means for securing the barrier to the ear tip (including adhesives or conforming attachment devices for example) is contemplated. FIG. 2G depicts a graph illustrating frequency response analysis data of the ear tips of FIGS. 2A-2G.

FIG. 2G illustrates that there is negligible influence of the barrier on sensitivity and frequency response in accordance with one embodiment of the present invention. As illustrated, the barrier presence has essentially no effect on the frequency response or sensitivity of the earphone. It is additionally contemplated that there are no noticeable artifacts imparted to the sound quality of the earphone that are not revealed from the frequency response data.

Figure 3A:
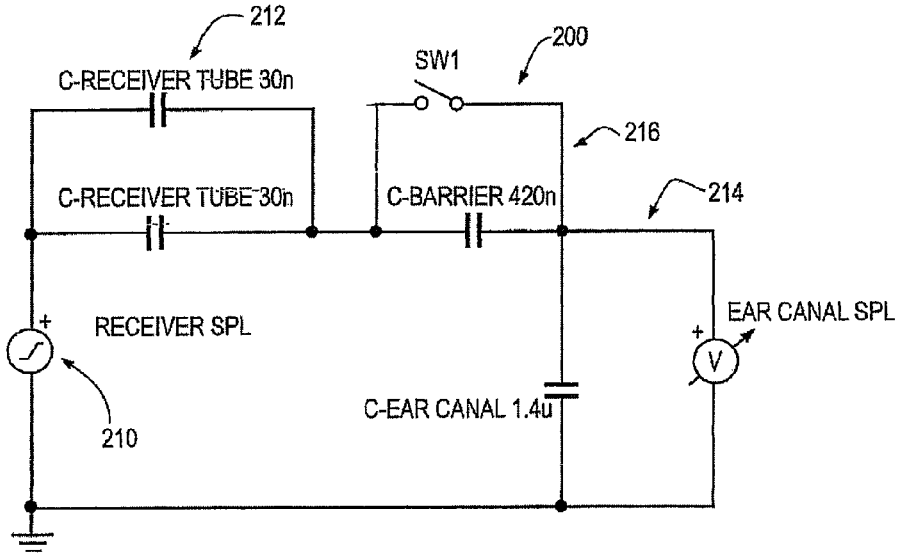
FIG. 3A illustrates a low frequency equivalent circuit representative of a hearing aid receiver, receiver tubing, ear canal volume and an acoustically transparent barrier in accordance with one embodiment of the present invention.

FIG. 3A illustrates a low frequency equivalent circuit 200 representative of a hearing aid receiver 210, receiver tubing 212, ear canal volume 214 and an acoustically transparent barrier 216 used to predict the low frequency attenuation behavior of Cerumen-Barrier (C-Barrier) assemblies in accordance with one embodiment of the present invention.

Figure 3B:
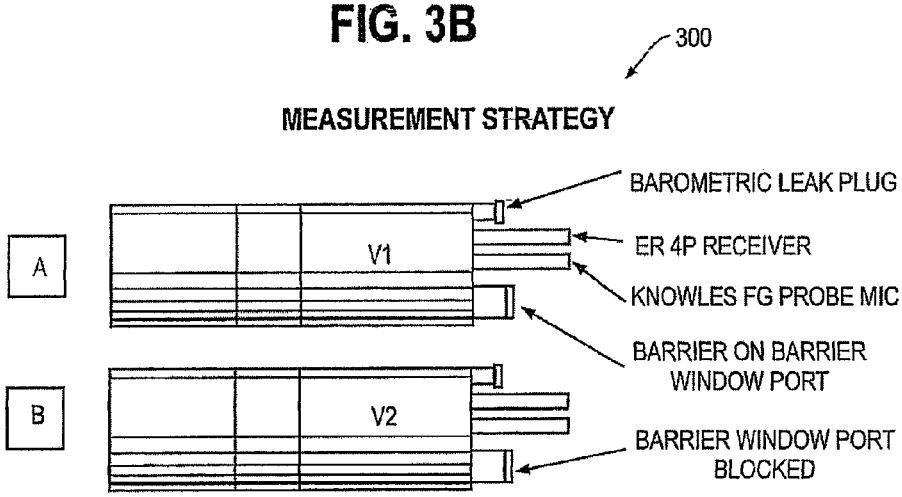
FIG. 3B illustrates a method for obtaining the equivalent compliance of an acoustically transparent barrier in accordance with one embodiment of the present invention.
Figure 3C:
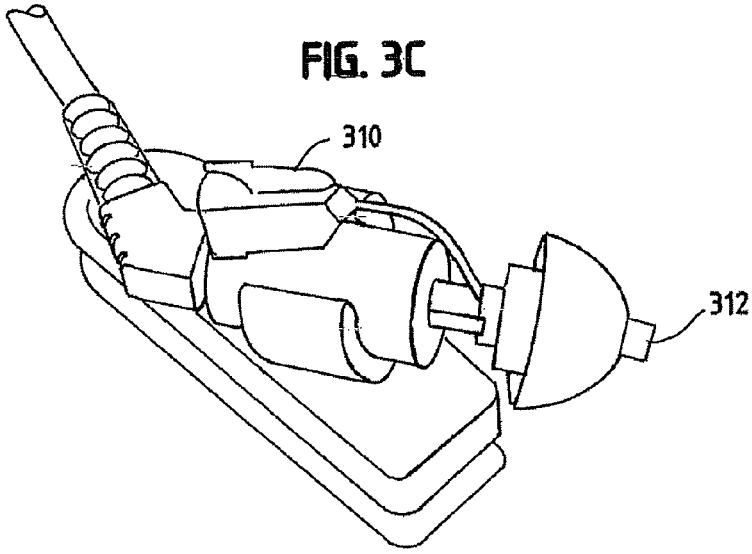
FIG. 3C illustrates a receiver assembly with an open receiver tubing sound exit.
Figure 3D:
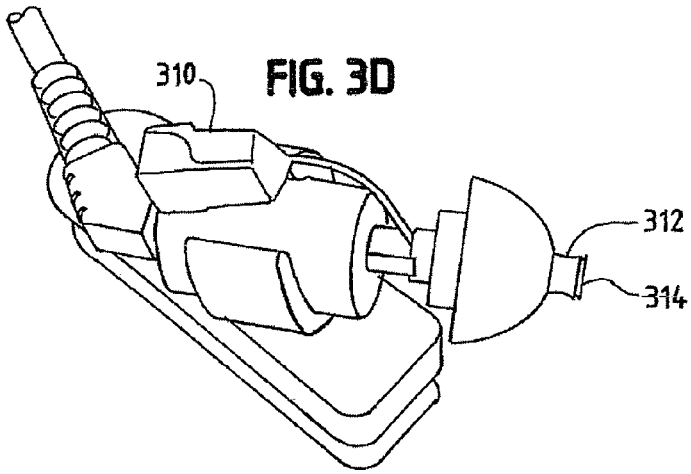
FIG. 3D illustrates a receiver assembly having an acoustically transparent barrier inserted into the receiving tubing sound exit.
Figure 3E:
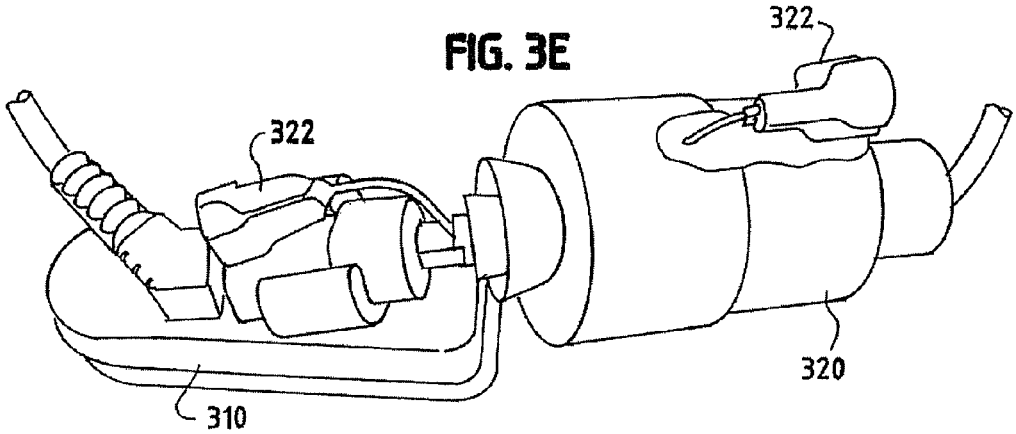
FIG. 3E illustrates a receiver assembly coupled to an ear simulator and measurement microphone assembly, wherein the assembly includes a device that protects the barrier from static pressure forces.
Figure 3F:
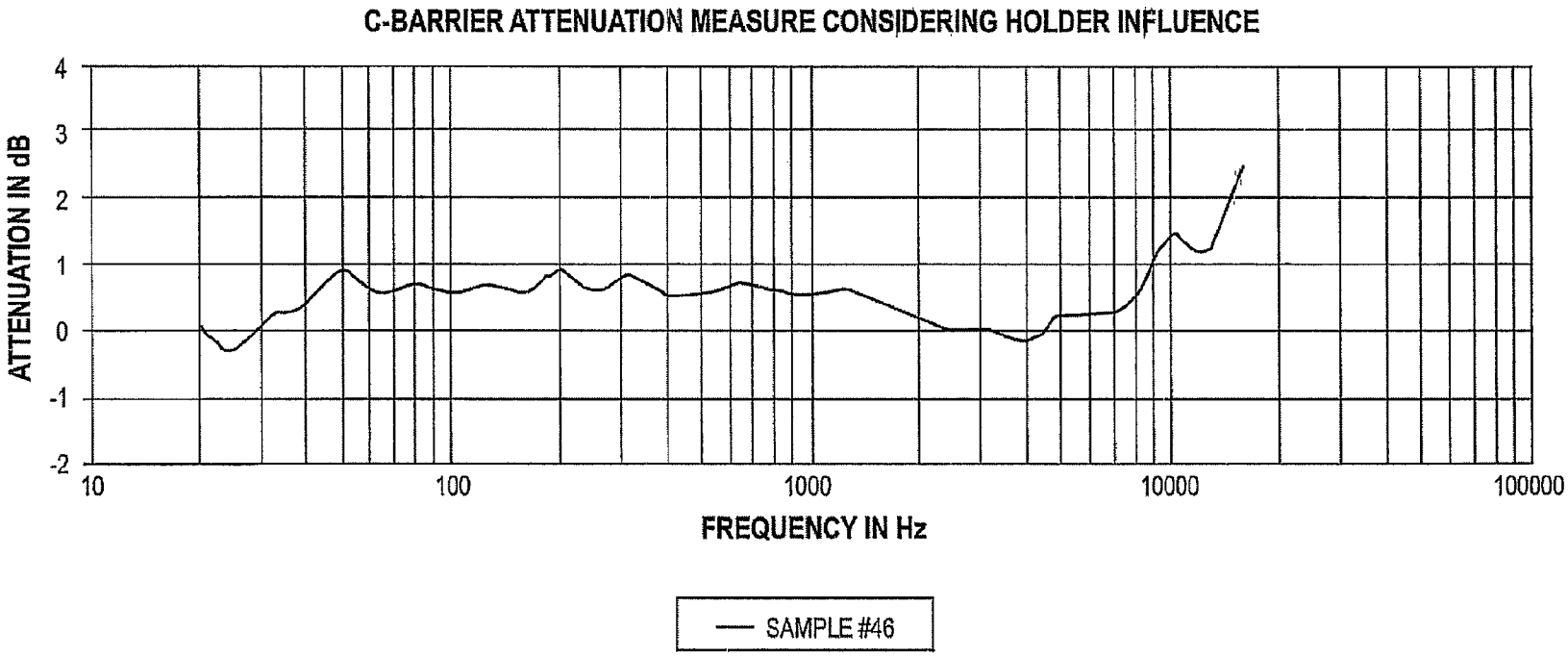
FIG. 3F depicts a graph illustrating wide frequency range attenuation measure of at least one embodiment of an acoustically transparent barrier in accordance with one embodiment of the present invention.

FIG. 3B illustrates a method 300 for determining the compliance of a C-Barrier in accordance with one embodiment of the present invention. In the illustrated embodiment, the CGS (Centimeter, Gram, Second) equivalent capacitance value corresponding to the measured equivalent volume, equals (Equivalent Volume)/1.43 as expressed in microfarads. A representative Cerumen-Barrier (Unit #46) was measured from a sample group of C-Barrier assemblies and found to have an analogous capacitance of 0.42 microfarads and a corresponding attenuation of 0.96 dB at 100 Hz.;

Experimental verification of the attenuation attributable to this example was made over a wide frequency range using the test set up illustrated in FIGS. 3C-3E. In the illustrated embodiment, a representative receiver assembly with and without a Cerumen Barrier is connected to an ear volume simulator, and a sound level measurement made for the two conditions. The attenuation attributable to the Cerumen-Barrier is consequently the difference between these to measurements. FIG. 3C illustrates a receiver assembly 310 with an open receiver tubing sound exit 312; FIG. 3D illustrates a receiver assembly 310 having an acoustically transparent barrier 314 inserted into the receiving tubing sound exit 312; while FIG. 3E illustrates a receiver assembly 310 coupled to an ear simulator and measurement microphone assembly. FIG. 3F depicts a graph illustrating a wide frequency range attenuation measure of at least one embodiment of an acoustically transparent barrier in accordance with one embodiment of the present invention. Specifically, FIG. 3F illustrates the attenuation properties of sample #46. It should be noted that the short sections of hypodermic needle 322 of FIG. 3E (approximately 0.005" ID) inserted into the receiver tubing and the simulated ear volume serve to relieve any static pressure that may develop across the Cerumen-Barrier during measurement. Such static pressure may significantly offset the quiescent position of the barrier resulting in misleading performance values. This is also a concern when barriers are used with devices. In at least one embodiment, a leakage path is provided on each side of the barrier to a common pressure, protecting the barrier from static pressure forces.

Figure 4A:
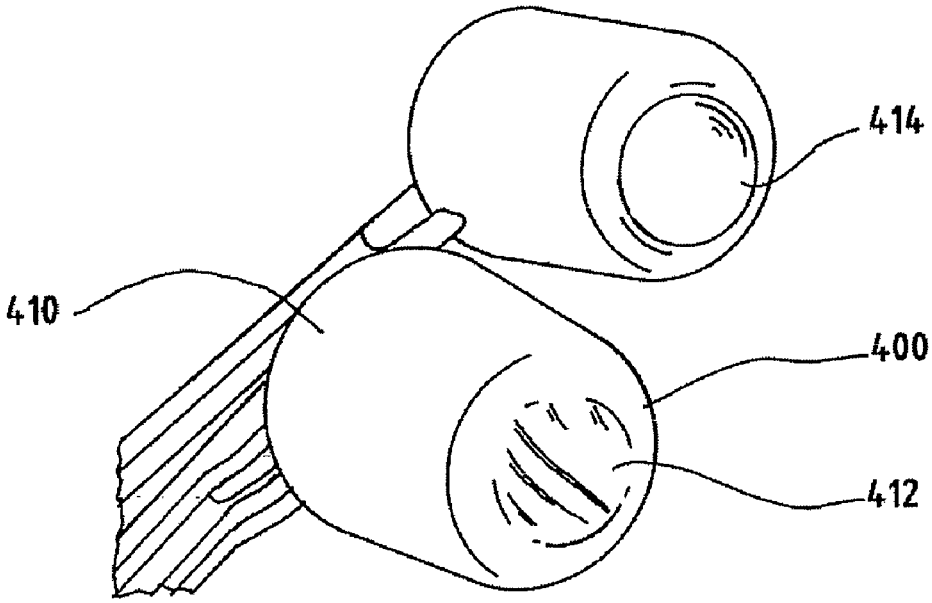
FIG. 4A depicts a barrier applied to an expandable foam-type ear tip in accordance with one embodiment of the present invention.
Figure 4B:
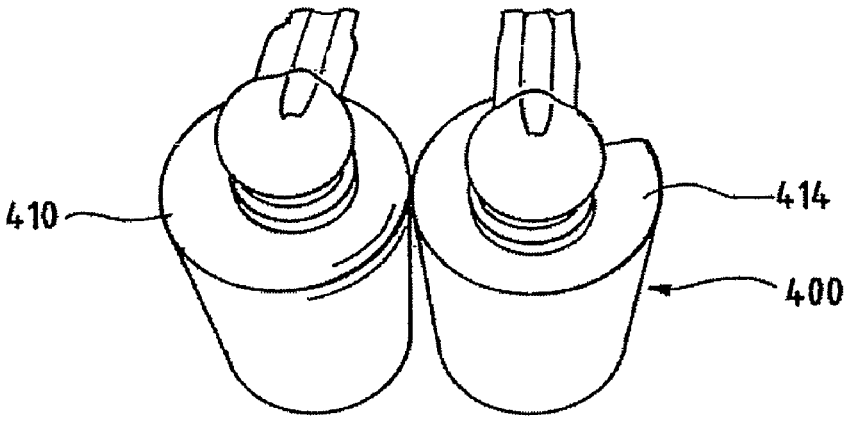
FIG. 4B depicts a rear view of the foam-type ear tip of FIG. 4A having a barrier applied thereto in accordance with one embodiment of the present invention.

Further analysis and simulation shows that for smaller ear canal volumes, the simulated ear canal capacitance would be smaller, and the predicted attenuation smaller for a given Cerumen-Barrier. It should be appreciated that for larger volumes the attenuation would be somewhat greater. FIGS. 4A and 4B depict expandable foam type ear tips 400 in accordance with one embodiment of the present invention. FIG. 4A depicts a front view of two foam type ear tips 400, one 410 having a barrier 412 applied thereto, one 414 not. FIG. 4B depicts a rear view of the foam-type ear tips of FIG. 4A.

Figure 5A:
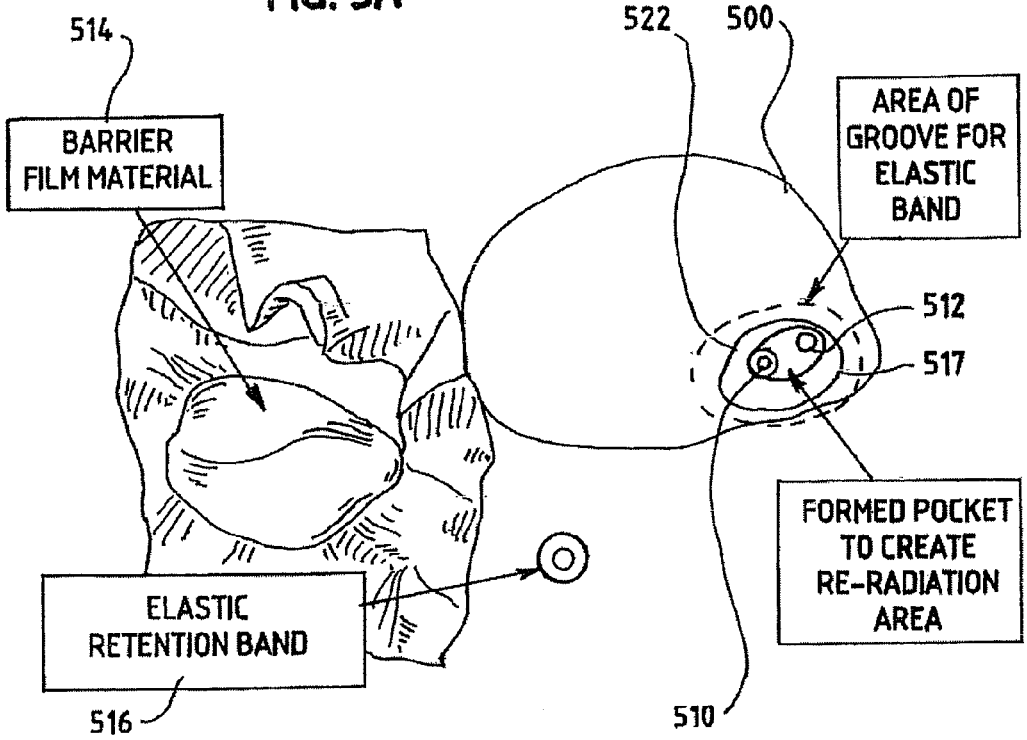
FIG. 5A depicts an in-the-ear hearing aid having a sound output port and the acoustic vent modified to receive a mechanical device adapted to secure a barrier thereto in accordance with one embodiment of the present invention.
Figure 5B:
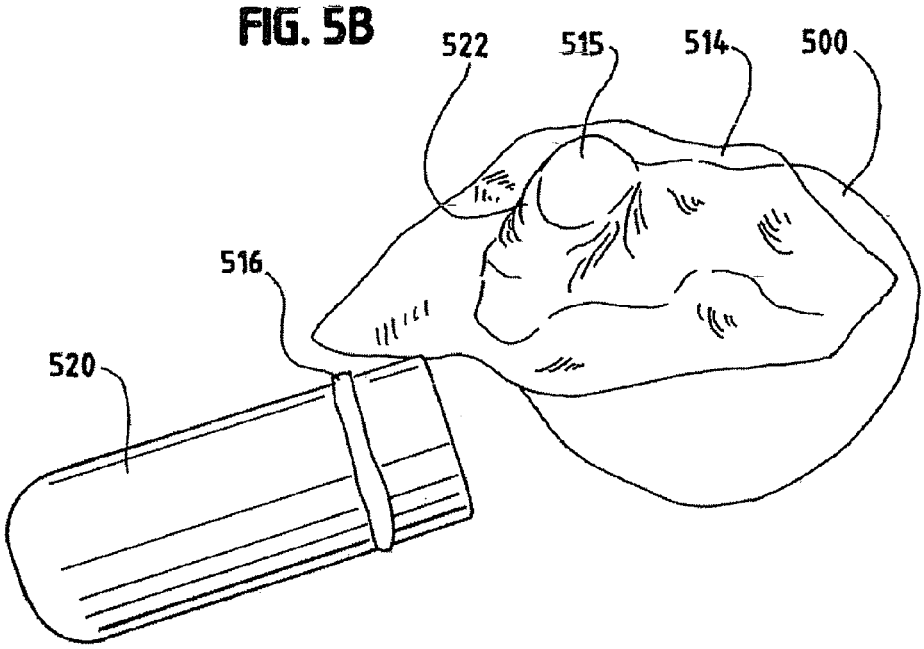
FIG. 5B depicts the in-the-ear hearing aid of FIG. 5A having a barrier partially applied thereto and an elastic band attachment fixture having a mechanical device (an elastic fastener for example) adapted to fix the mechanical device to the hearing aid in accordance with one embodiment of the present invention.
Figure 5C:
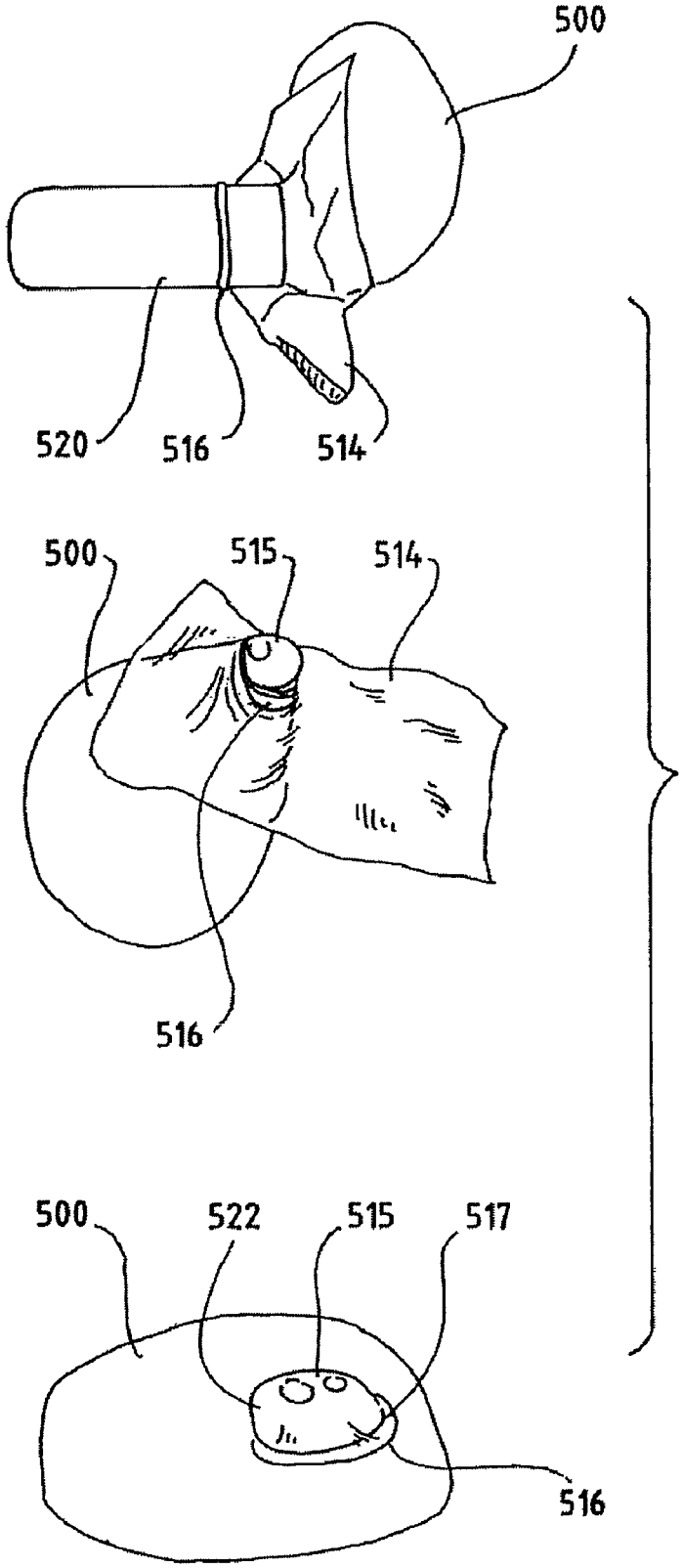
FIG. 5C depicts a sequence of photos illustrating securing the barrier to in-the-ear hearing aid of FIG. 5B using a mechanical device in accordance with one embodiment of the present invention.

FIGS. 5A-5C depict an in-the-ear (also referred to as an "ITE") hearing aid 500 having a sound output port 510 and an acoustic vent 512 in accordance with one embodiment of the presenting invention. FIG. 5A depicts the ITE hearing aid 500, barrier film material 514 and a mechanical device 516 (an elastic retention band for example) modified to accept a barrier 515. In particular, FIG. 5A depicts the ITE hearing aid 500 having a slot or groove 517 adapted to receive the mechanical device and a formed pocket to create an adequate re-radiation area. FIG. 5B depicts the ITE hearing aid 500 of FIG. 5A having a barrier 515 partially applied thereto and an elastic band attachment fixture having a mechanical device 520 (an elastic fastener for example) used to place the mechanical device 516 on the hearing aid and fix the film thereto.

FIG. 5C depicts a sequence of photos illustrating a barrier 515 being secured to the ITE hearing aid 500 of FIG. 5B without affecting the size or fit of the hearing aid. In the illustrated embodiment, the groove 517 formed in the canal tip area 522 provides a location for the elastic band, providing a flush surface along the canal tip area 522. In one embodiment, the elastic band may extend beyond the retention notch improving the film seal. It should be appreciated that while a mechanical device 516 is used to fix the film to the acoustic device, other means for attaching the film are contemplated. As an example, it is contemplated that the film and elastic band may be combined into a single unitary member, where the elastic band portion has the same or different elasticity than the film portion.

Figure 6A:
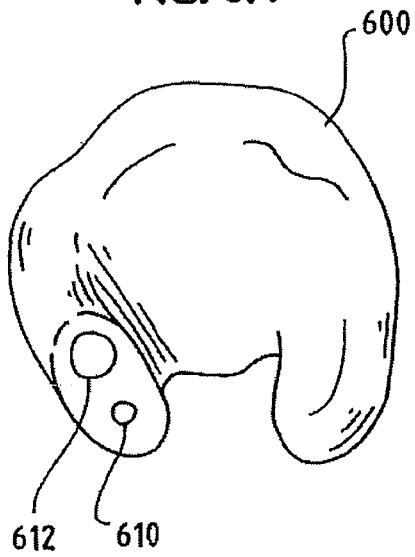
FIG. 6A depicts an in-the-ear hearing aid prior to attaching a barrier adapted to cover both the sound output port and the acoustic vent in accordance with one embodiment of the present invention.
Figure 6B:
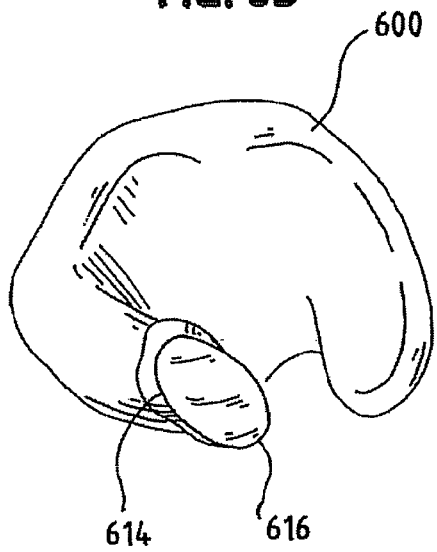
FIG. 6B depicts the in-the-ear hearing aid of FIG. 6A having a barrier applied thereto, secured using a conforming attachment device in accordance with one embodiment of the present invention.

FIGS. 6A and 6B depict an ITE hearing aid 600 having sound output port 610 and an optional acoustic vent 612 in accordance with one embodiment of the present invention. FIG. 6A illustrates the hearing aid 600 prior to attaching a barrier. FIG. 6B illustrates ITE hearing aid 600 of FIG. 6A having a barrier 614 applied thereto, adapted to cover both the sound output port 610 and an optional acoustic vent 612 and secured using a conforming attachment device 616.

Figure 6C:
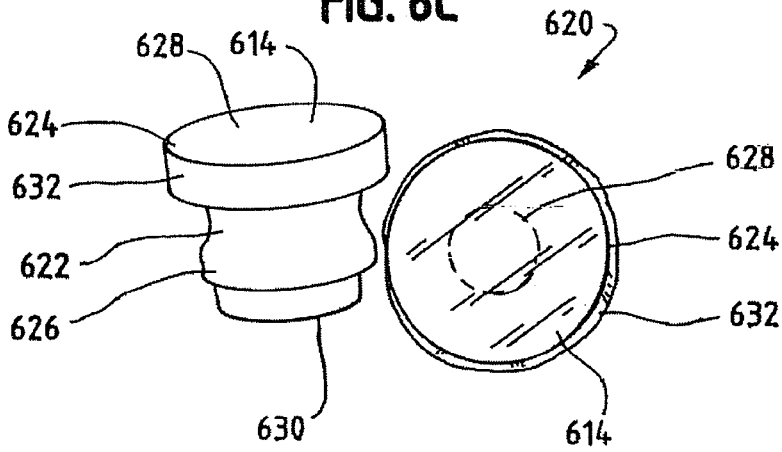
FIG. 6C depicts an elevational and end view of examples of attachment devices having an acoustically transparent barrier and designed to removably fit in a port or tube of an acoustic device in accordance with one embodiment of the present invention.

FIG. 6C depicts one or more embodiments of a conforming attachment device (generally designated 620) adapted to be removably, securably coupled to (inserted for example) an acoustic device 600 similar to any devices described previously.

FIG. 6C depicts an elevational and end view of an example of a conforming attachment device 620 having an acoustically transparent barrier 614 fixed or coupled thereto using any suitable heat, mechanical or adhesive process in accordance with one embodiment of the present invention. In the illustrated embodiment, device 620 has a housing 622 defining opposing first and second ends 624 and 626 and having a generally cylindrical shape when viewed from the side. In at least one embodiment, housing 622 has an outer diameter or size slightly larger than the diameter of a port (a rubber like sound tube for example), such that the device may be securely removable placed in the port.

First and second ends 624 and 626 define opposing openings 628 and 630 respectively. Further, first end 624 defines a lip or mounting surface 632, which extends from, and is substantially parallel to, housing 622 at first end 624, although other relationships are contemplated. In at least one embodiment, mounting surface 632 has a diameter of about 3.00 mm or less (2.75 mm or less for example). Further, at least first end 624 defines opening 628 having a diameter of about 2.5 mm or less. It is contemplated that, in at least one embodiment, second end 626 has a diameter between about 1.3 mm to about 2.4 mm, although other arrangements are contemplated. It should be appreciated that first and second ends may define more than one opening.

Figure 6D:
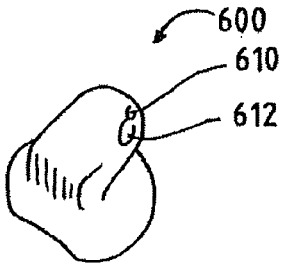
FIG. 6D depicts an in-the-ear hearing aid prior to removably receiving the attachment device and barrier of FIG. 6C in accordance with one embodiment of the present invention.
Figure 6E:
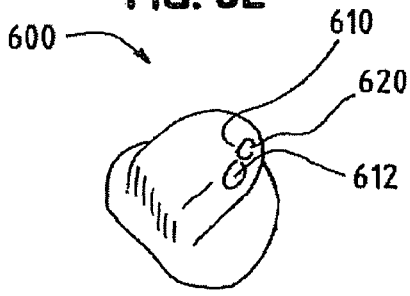
FIG. 6E depicts the in-the-ear hearing aid of FIG. 6D having an attachment device and barrier applied thereto in accordance with one embodiment of the present invention.

In at least one embodiment, a barrier 614 is fixed to at least one end of the of the conforming attachment device 620. In the illustrated embodiment, barrier 614 is fixed to the first end 624 using any of the processes discussed herein. FIG. 6D illustrates a hearing device 600 adapted to removably accept a conforming attachment device similar to that described previously. FIG. 6E illustrates the hearing device 600 having attachment device 620 inserted therein using an insertion/removal tool for example.

Figure 7A:
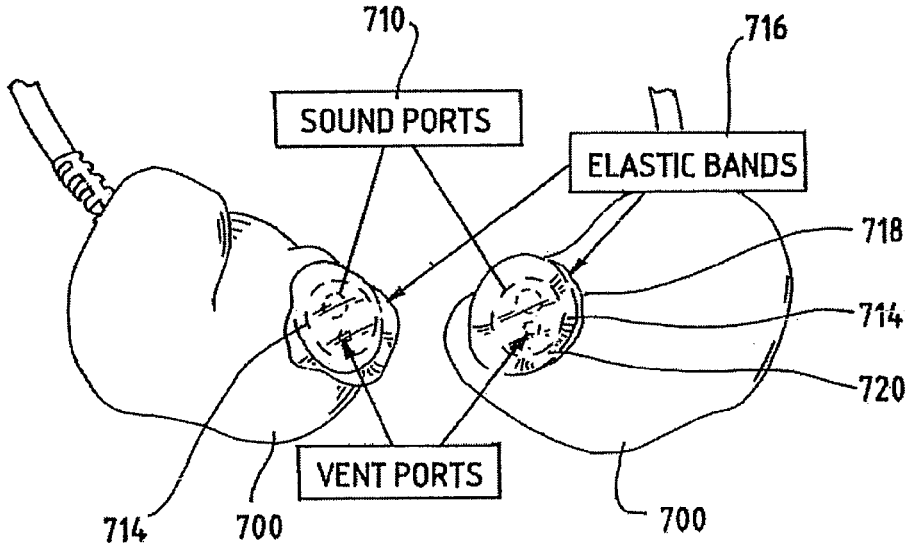
FIG. 7A depicts custom earmolds having a sound output port and optional acoustic vent having an acoustically transparent barrier applied thereto in accordance with one embodiment of the present invention.
Figure 7B:
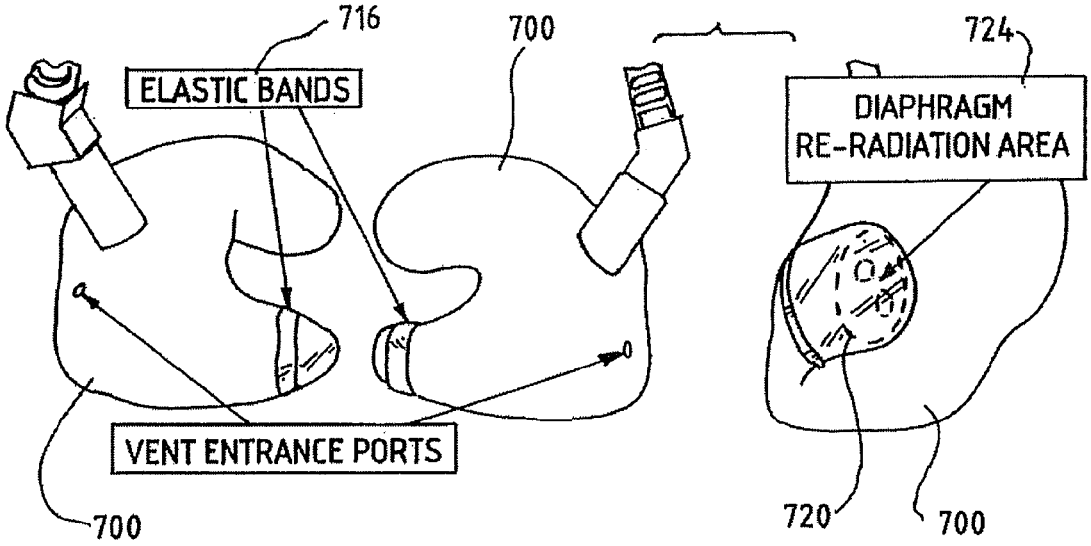
FIG. 7B depicts additional views of the custom earmolds of FIG. 7A with a barrier applied thereto secured using a mechanical device in accordance with one embodiment of the present invention.

FIGS. 7A and 7B depict custom ear molds 700 typically used with behind-the-ear (alternatively referred to as an "BTE") hearing aids, and sound monitoring devices. These ear molds 700 may include a sound output port 710 and an acoustic vent 712 in accordance with one embodiment of the present invention. FIG. 7A depicts the ear molds 700 with acoustically transparent barriers 714 applied thereto using one or more elastic bands 716. In the illustrated embodiment, one or more grooves or notches 718 are formed in the earmold 700, adapted to receive the elastic band and provide for flush attachment. In the illustrated embodiment, the sound and vent ports are recessed (indicated in FIG. 7A by the dotted line 720) so as to provide a sufficient re-radiation area.

FIG. 7B depicts additional views of the custom ear molds 700 of FIG. 7A with a barrier applied and secured thereto. The earmolds on the left of FIG. 7B illustrate the areas of attachment adapted to receive the elastic bands 716, while the right side of FIG. 7B provides further detail regarding the sound and vent ports 710 and 712, the recessed area and re-radiation area 724 in accordance with one embodiment of the present invention.

Figure 7C:
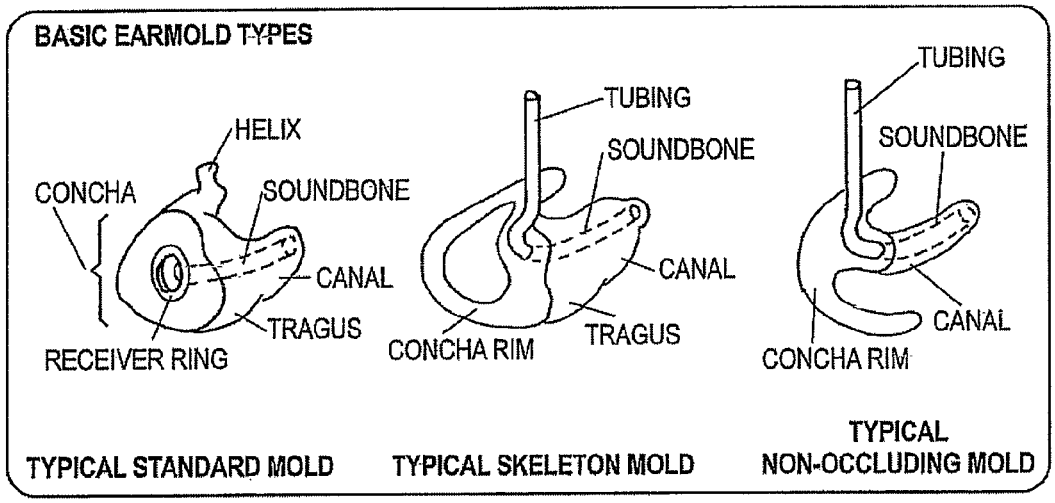
FIG. 7C depicts various embodiments of earmold types that may be used with the inventive barrier and a variety of in-ear devices.
Figure 7C:
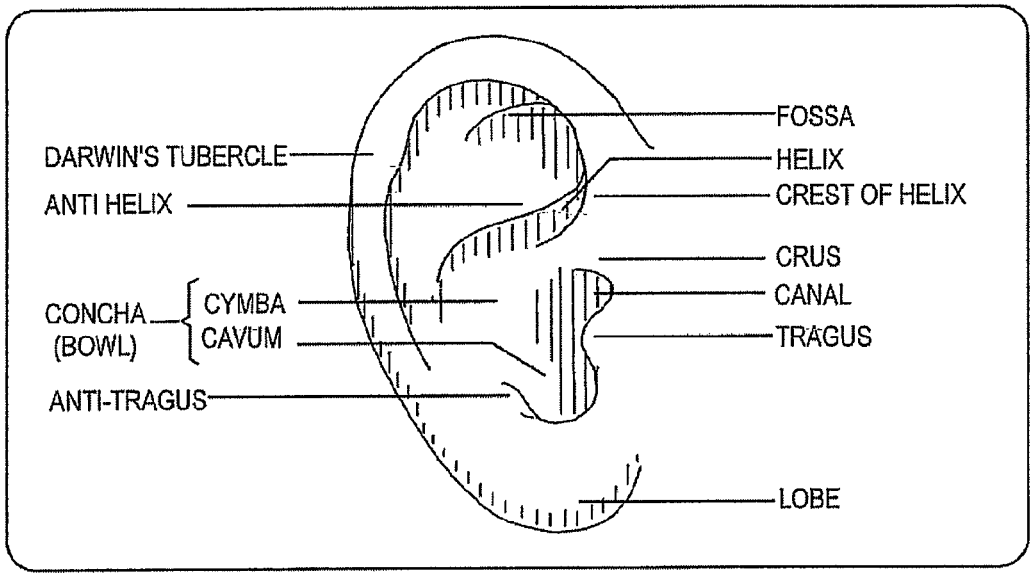

FIG. 7C depicts various embodiments of earmold types that may be used with a wide variety of hearing aid and communication devices and suitable for use with one or more embodiments of the barrier in accordance with the present invention. FIG. 7C further illustrates common terminology associated with the external portion of the human ear in accordance with a variety of embodiments of the present invention.

Figure 7D:
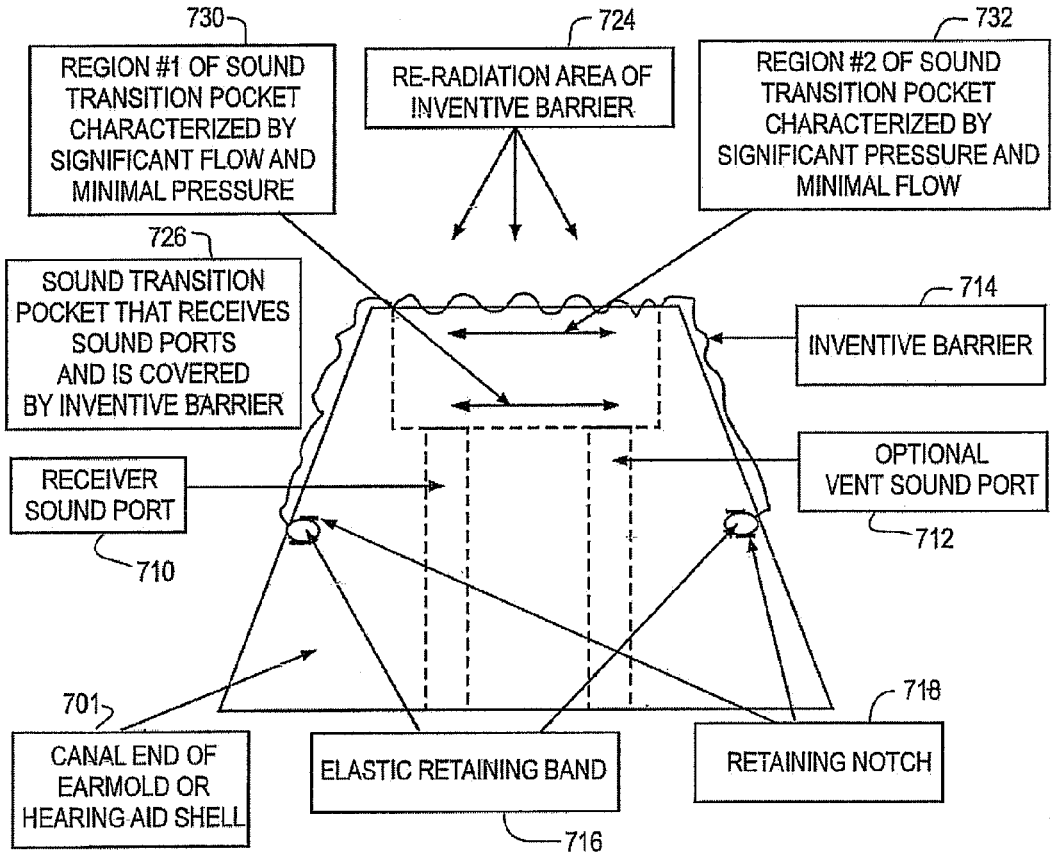
FIG. 7D depicts a diagram illustrating the relationship between the canal end of an earmold or hearing aid shell, a barrier, a retaining elastic band, a retaining notch, a pocket in the end of the mold or shell, sound exit ports for a receiver and an optional vent sound port in accordance with one embodiment of the present invention.

FIG. 7D depicts a diagram illustrating the relationship between the canal end 701 of an earmold 700 or hearing aid shell and an acoustically transparent barrier. The diagram further illustrates the sound re-radiation area 724 of the structure, a pocket 726 in the end of the mold or shell and the receiver and vent sound ports 710 and 712. The indicated pocket serves to form a needed transition volume in which the relatively low sound pressure and high flow (volume velocity) associated with Region #1 730 may transition to the relatively low flow and high pressure associated with Region #2 732. Region #2 732 represents the area proximate to the barrier that re-radiates the sound. In one embodiment, this pocket is about 1 mm to about 2 mm in depth and equivalent in area to a circle of about 3 mm diameter. The illustrated embodiment further depicts a retaining notch adapted to receive one or more elastic retaining bands, affixing or securing the barrier to the earmold or hearing aid shell. In at least one embodiment of the present invention, it is contemplated that Region #1 730 may have a more conical shape than that depicted in FIG. 7D. It is contemplated that the conical shape may minimize the size of the barrier assembly.

Figure 8A:
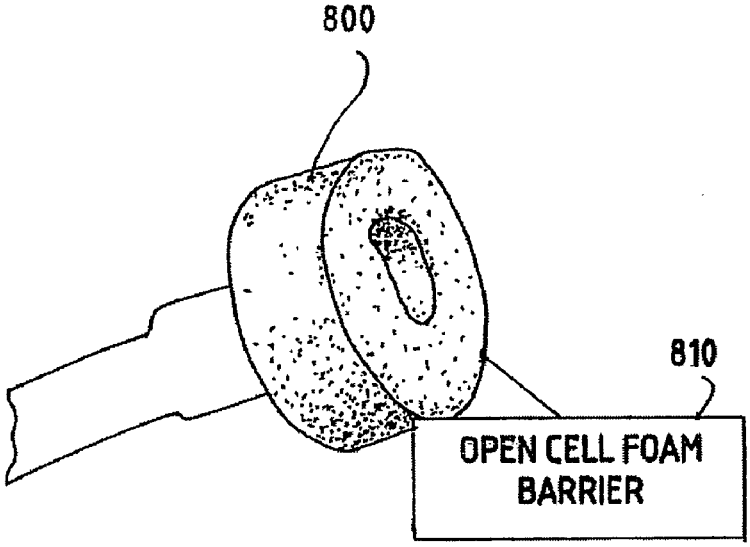
FIG. 8A depicts a "snap tip" foam-type earmold manufactured by Hearing Components Corporation using open-cell type foam as a barrier.
Figure 8B:
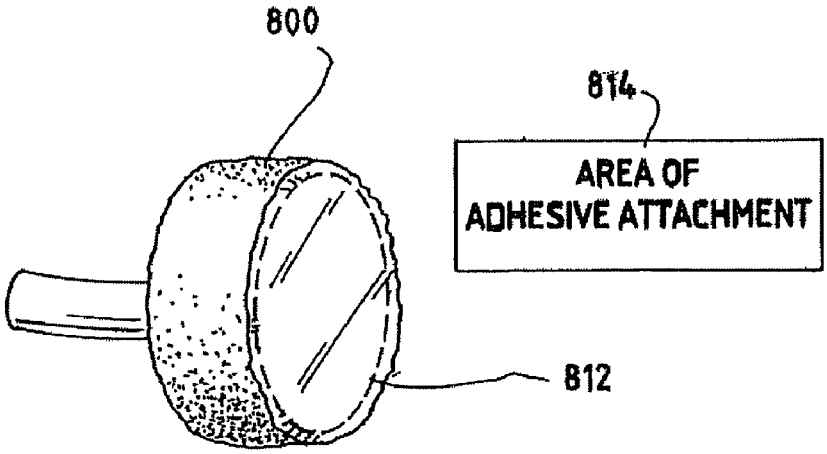
FIG. 8B depicts an acoustical transparent barrier applied to the "snap tip" foam-type earmold similar to that depicted in FIG. 8A secured using adhesive in accordance with one embodiment of the present invention.

FIGS. 8A and 8B depict a "snap tip" foam-type earmold 800 manufactured by Hearing Components Corporation in accordance with one embodiment of the present invention. FIG. 8A depicts the earmold 800 in its normal form without an inventive barrier but using an open cell foam member 810, while FIG. 8B depicts an acoustical transparent barrier 812 applied to the "snap tip" foam-type earmold 800 (using adhesive for example as indicated by the dotted line 814) in accordance with one embodiment of the present invention.

Figure 9A:
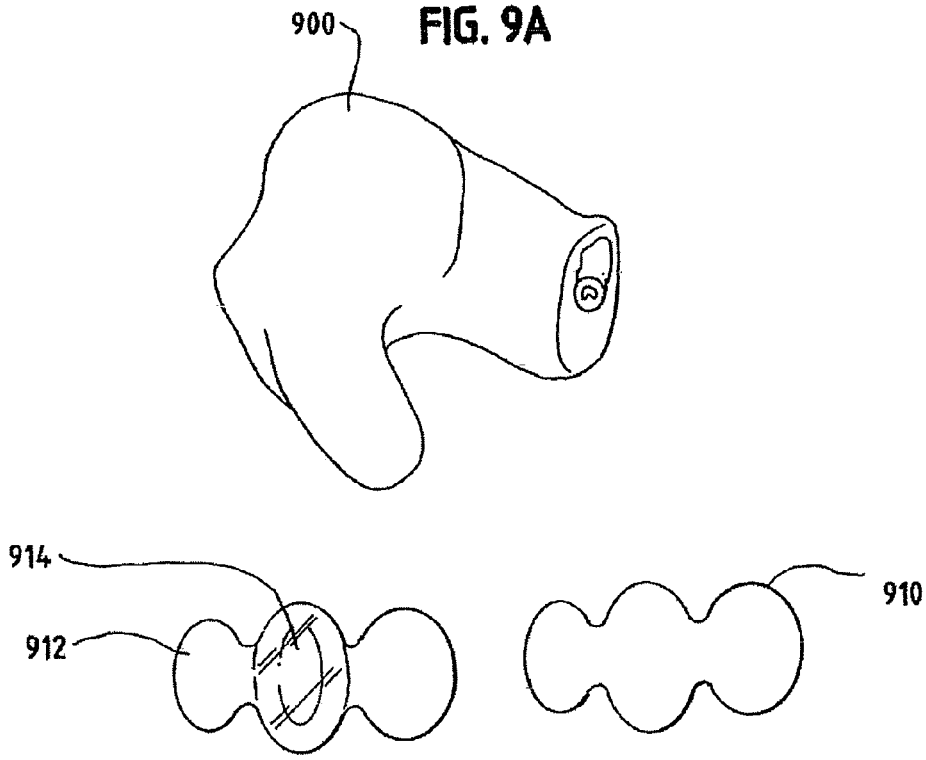
FIG. 9A depicts an in-the-ear hearing aid, a known adherence type barrier guard and an adherence type barrier guard modified to include a transparent acoustical barrier in accordance with one embodiment of the present invention.
Figure 9B:
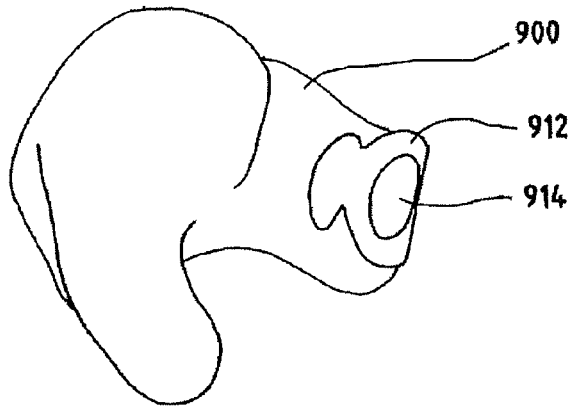
FIG. 9B depicts the in-the-ear hearing aid of FIG. 9A having the adherence type barrier modified to include the transparent acoustical barrier applied thereto in accordance with one embodiment of the present invention.

Another embodiment of an ITE hearing aid 900 is depicted in FIGS. 9A and 9B. FIG. 9A also depicts a known band-aid like wax guard 910 manufactured by Hearing Components Corporation and the same guard 912 modified to include a transparent acoustical barrier 914 in accordance with one embodiment of the present invention. FIG. 9B depicts the ITE hearing aid 900 of FIG. 9A having the modified adherence type barrier 912 applied thereto.

Figure 10A:
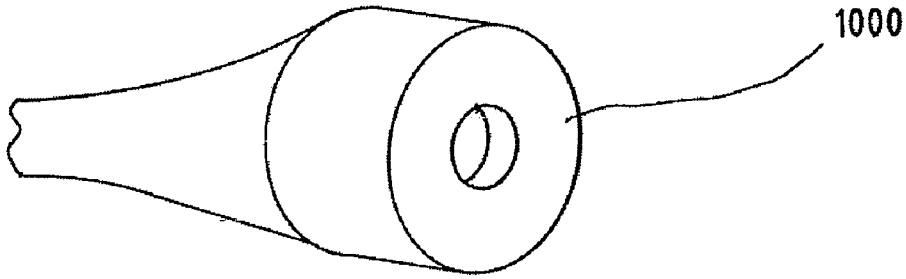
FIG. 10A depicts an omnidirectional microphone prior to securing a barrier thereto in accordance with one embodiment of the present invention.
Figure 10B:
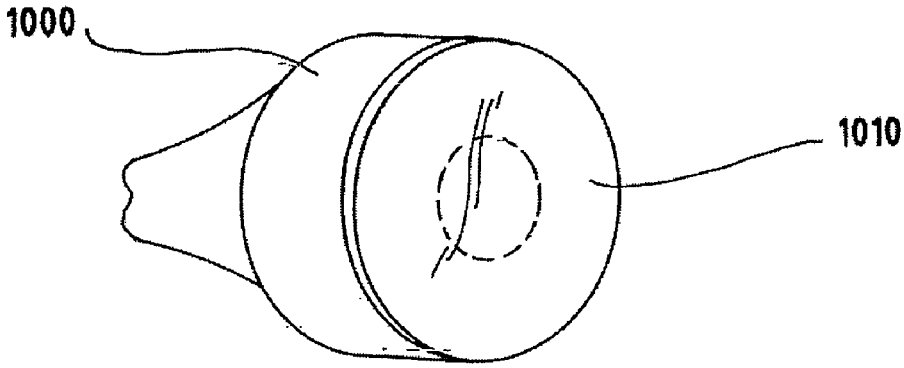
FIG. 10B depicts the microphone of FIG. 10A having a barrier applied thereto in accordance with one embodiment of the present invention.
Figure 10C:
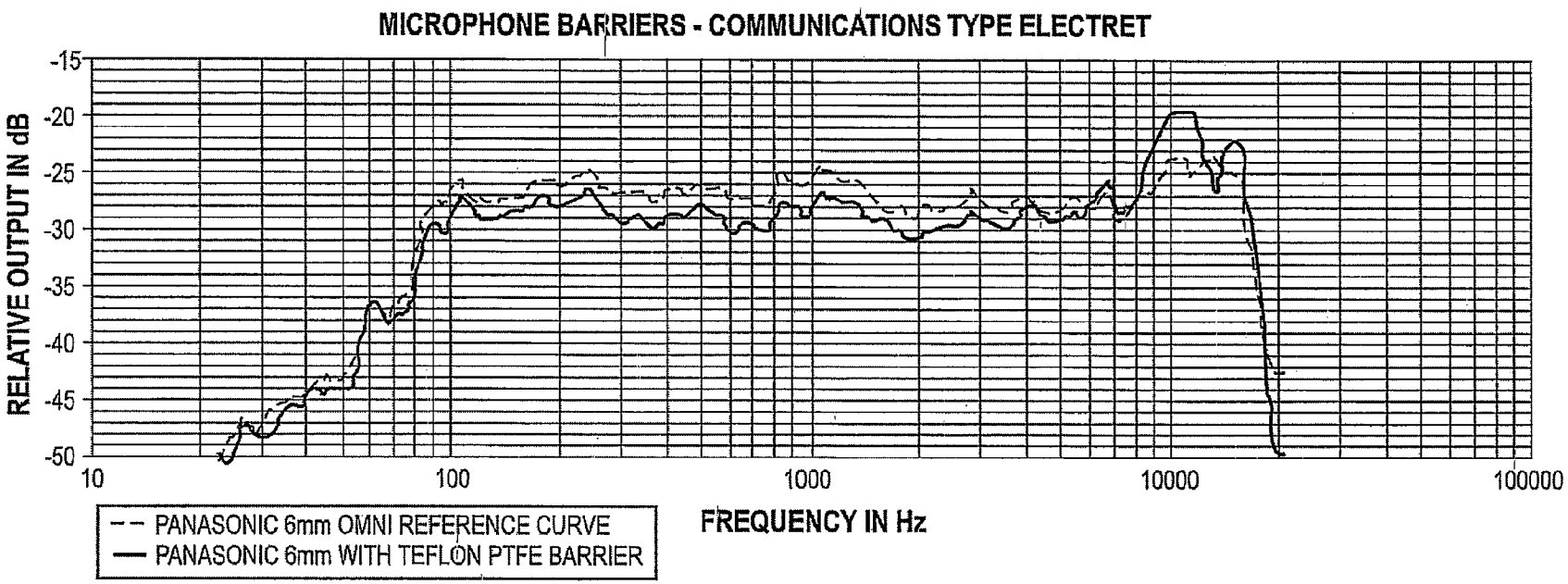
FIG. 10C depicts a graph illustrating frequency response analysis of the microphones of FIGS. 10A-10B showing the negligible influence of the barrier on sensitivity and frequency response in accordance with one embodiment of the present invention.

FIGS. 10A-10B depict an omnidirectional microphone 1000 in accordance with one embodiment of the present invention. FIG. 10A depicts a 6 mm diameter omnidirectional microphone 1000 typically used for communication applications. FIG. 10B depicts the microphone 1000 of FIG. 10A having a barrier 1010 applied thereto in accordance with one embodiment of the present invention. FIG. 10C depicts a graph illustrating a frequency response analysis of the microphones of FIGS. 10A-10B. The illustrated graph demonstrates the negligible influence of the barrier on the sensitivity and frequency response of the microphone.

Figure 11A:
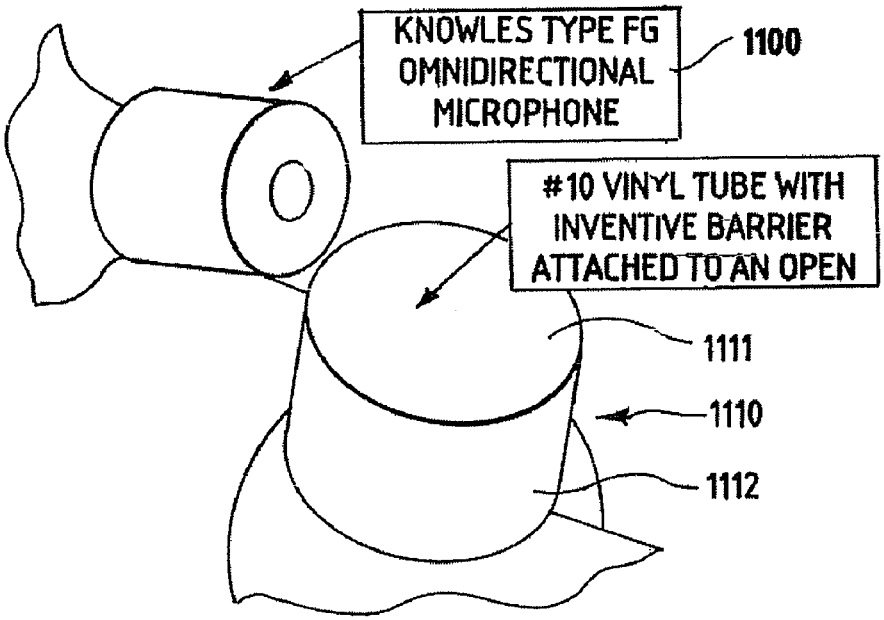
FIG. 11A depicts an omnidirectional hearing aid microphone and a tube (a #10 vinyl tube for example) having a barrier affixed to one of the open ends and adapted to be attached to the microphone in accordance with one embodiment of the present invention.
Figure 11B:
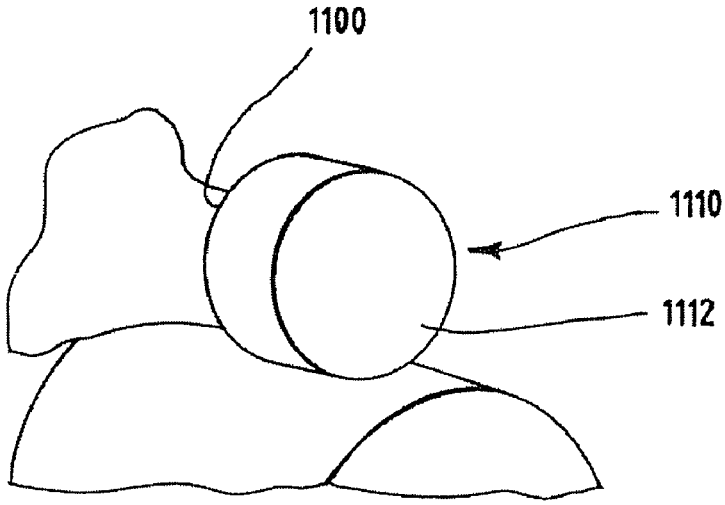
FIG. 11B depicts the omnidirectional hearing aid microphone of FIG. 11A with the vinyl tube and barrier attached thereto in accordance with one embodiment of the present invention.
Figure 11C:
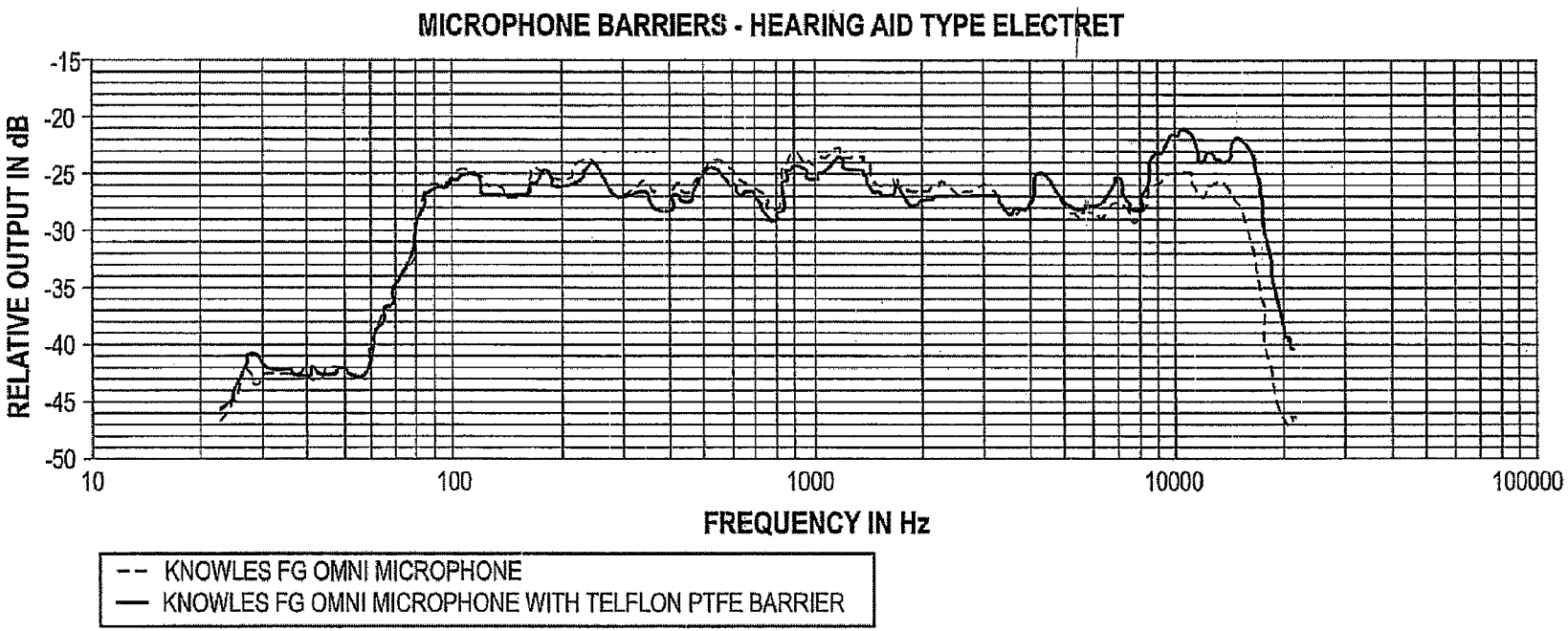
FIG. 11C depicts a graph illustrating the frequency response analysis data of the omnidirectional hearing aid microphone of FIGS. 11A-11B showing the negligible influence of the barrier on sensitivity and frequency response in accordance with one embodiment of the present invention.

FIG. 11A depicts an omnidirectional hearing aid microphone 1100 and an unattached acoustically transparent barrier assembly 1110. The acoustically transparent barrier 1111 is secured to one end of a tube 1112 (a #10 vinyl tube for example), which is adapted to be attached to the microphone in accordance with one embodiment of the present invention. FIG. 11B depicts the omnidirectional hearing aid microphone 1100 of FIG. 11A having the vinyl tube 1112 (with barrier 1111) attached to the microphone. FIG. 11C depicts a graph illustrating the frequency response analysis data of the omni-directional hearing aid microphone of FIGS. 11A-11B showing the negligible influence of the barrier on sensitivity and frequency response of the microphone. It should be appreciated that, if desired, the impedance of the barrier may be modified, so as to offer both protection and a given amount of attenuation.

Figure 11D:
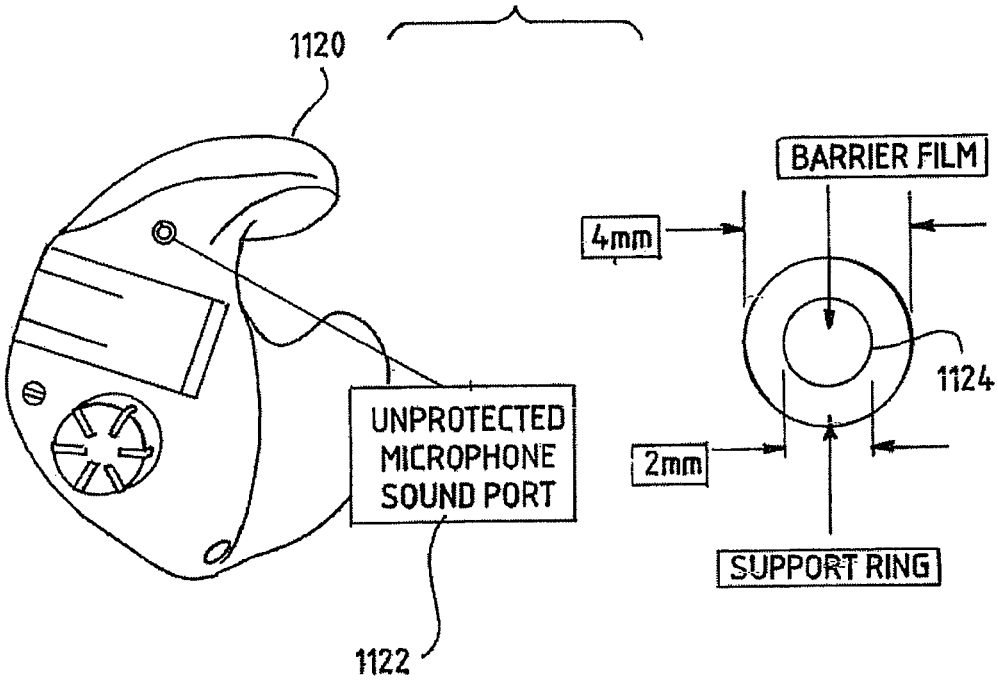
FIG. 11D depicts an in-the-ear hearing aid with an unprotected microphone sound entry port and an acoustically transparent barrier port cover in accordance with one embodiment of the present invention.
Figure 11E:
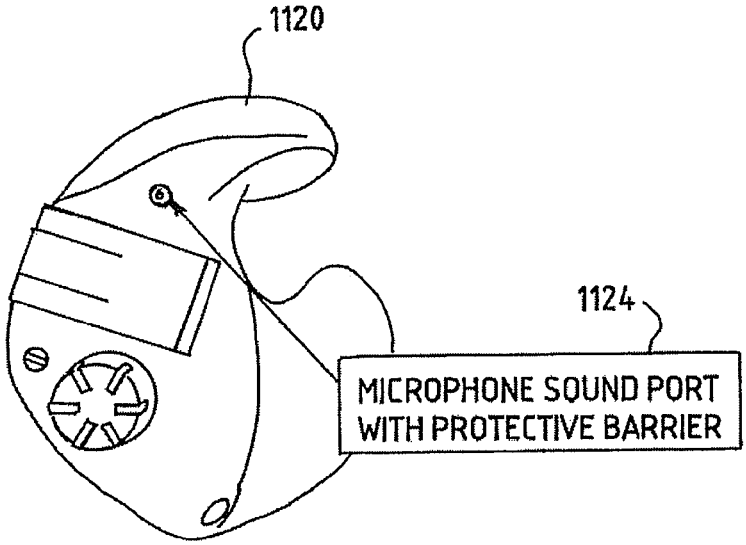
FIG. 11E depicts an in-the-ear hearing aid with an acoustically transparent barrier port cover applied thereto in accordance with one embodiment of the present invention.

FIGS. 11D & 11E depict embodiments of an ITE hearing aid 1120 with one or more microphone sound entry ports 1122. Specifically, FIG. 11D depicts the ITE hearing aid 1120 with an unprotected microphone sound entry port 1122 and an acoustically transparent barrier 1124. In this embodiment, the barrier is comprised of a 4 mm diameter support ring and film (about 2 mm in diameter). For hearing aid applications, one of the benefits of such barrier includes protecting at least the microphone from hairspray. FIG. 11E depicts the ITE hearing aid of FIG. 11D with an acoustically transparent barrier port cover applied thereto in accordance with one embodiment of the present invention. It should be appreciated that in the case of directional microphones, multiple sound ports are used and hence more than one barrier is required.

Figure 12:
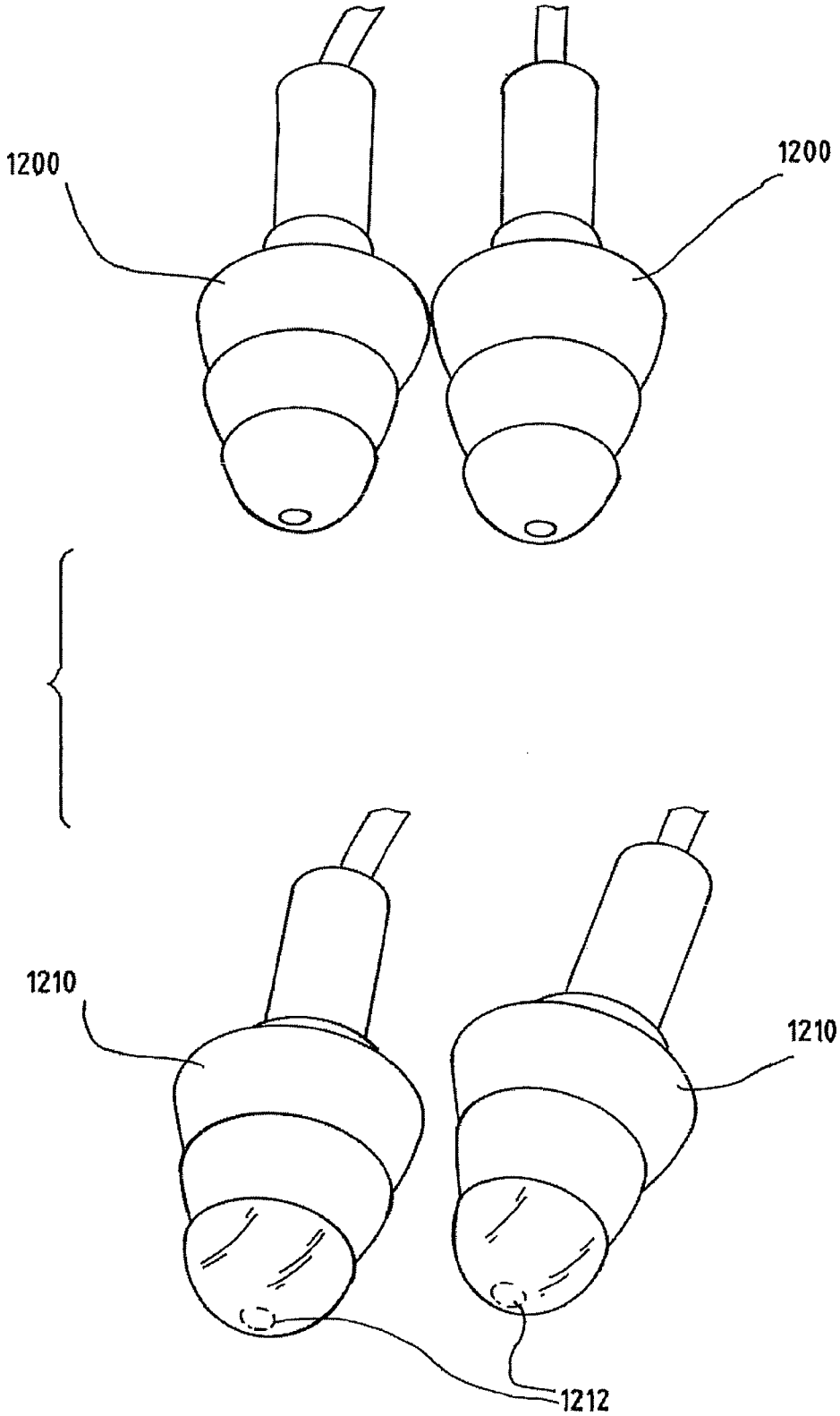
FIG. 12 depicts hearing protection attenuators, two attenuators without a barrier and two attenuators having a barrier applied thereto in accordance with one embodiment of the present invention.

FIG. 12 depicts hearing protection attenuators 1200 and 1210 in accordance with one embodiment of the present invention. Two attenuators 1200 are illustrated without barriers, while two attenuators 1210 are illustrated having a barrier 1212 applied thereto.

Figure 13A:
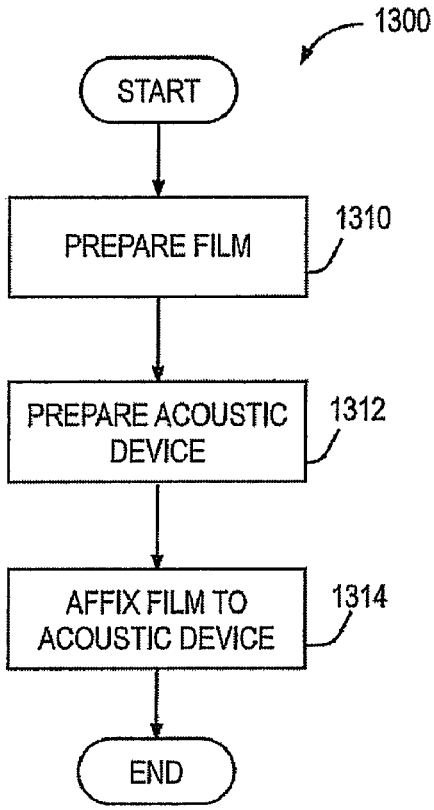
FIG. 13A depicts a high level flow chart depicting one method of forming a communication device in accordance with one embodiment of the present invention.
Figure 13B:
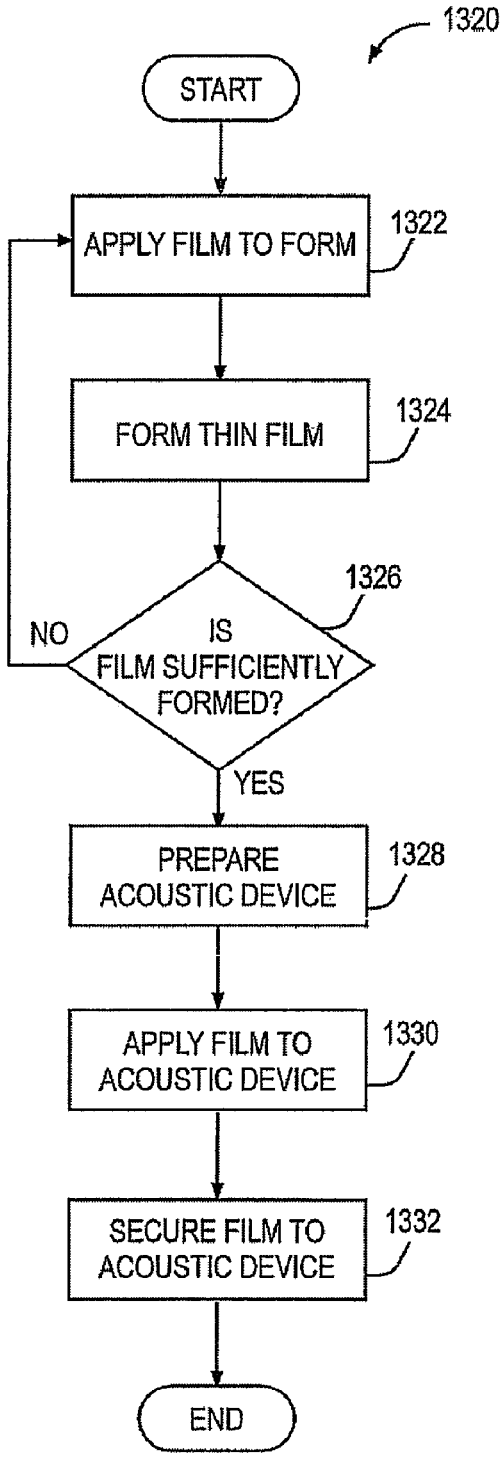
FIG. 13B depicts a detailed flow chart depicting one method of forming a communication device in accordance with one embodiment of the present invention.

FIGS. 13A & 13B depicts flow charts illustrating methods of forming and protecting a communication device (an acoustic device for example) in accordance with embodiments of the present invention. FIG. 13A depicts a high level flow chart depicting one method of forming a communication device comprising an acoustic device having a barrier. In this illustrated embodiment, the method 1300 comprises prepaping the barrier 1310 and affixing it to the accoustic device 1314. More specifically, one embodiment of the preset invention comprises preparing the film 1310 and the accoustic device 1312. After preperation, the film is affixed to the accoustic device 1314 forming the barrier.

In at least one embodiment, the material that comprises the film has a low mass, a low stiffness, is chemically resistant and a low sensitivity to temperature change. Further, the material has a high elongation and high impact strength. In at least one embodiment, the material comprises a polyethylene blend, where the polyethylene blend comprises at least an organometallic complex such as hexane or metalocine.

FIG. 13B depicts a detailed flow chart illustrating one method 1320 of forming a communication device comprising an acoustic device having a barrier in accordance with one embodiment of the present invention. In this illustrated embodiment, the method comprises appling the film to a forming device 1322 forming a suitable thin film 1324. It is then detemined whether the film is sufficently thin and of the correct shape 1326 (i.e., sufficently formed). If the film is improperly formed (i.e., the film is too thick or the wrong shape) it is reapplied to the forming device and reformed.

If the film is thin enough, the acoustic device is prepared 1328. In one embodiment, preparing the acoustic device comprise enlarging the sound port, from about 1 mm to about 3 mm for example, increasing the sound re-radiation area. The film is applied to the acoustic device 1330 and fixed thereto 1332 using a mechanical device, although any means for securing the barrier to the ear tip (including glue or conforming attachment device for example) are contemplated.

Figure 14A:
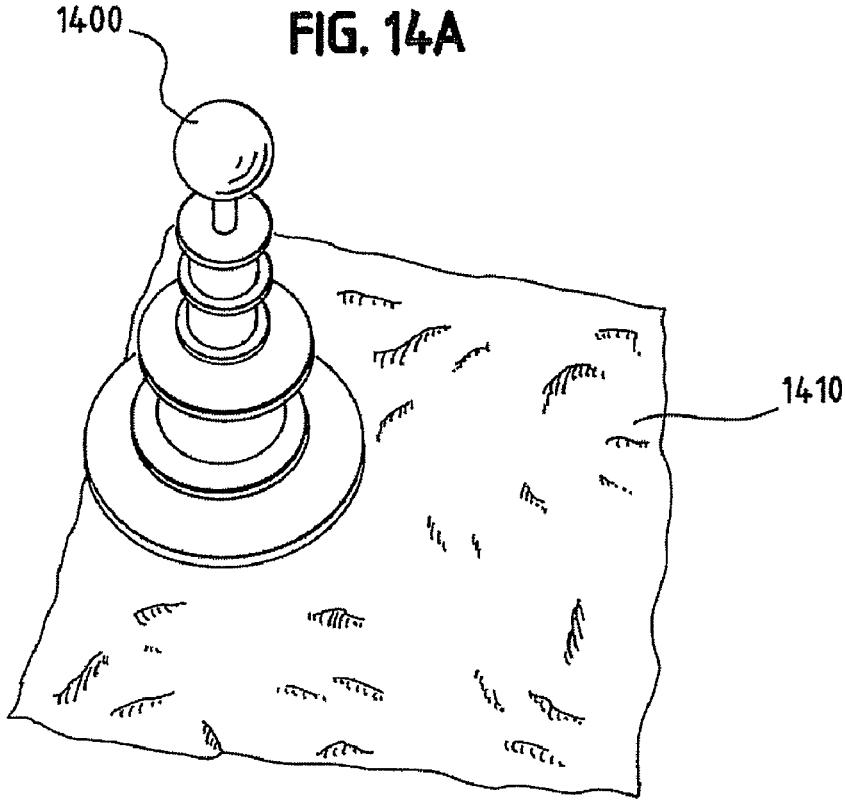
FIG. 14A depicts a stretching form and barrier film material for application to an acoustic device in accordance with one embodiment of the present invention.
Figure 14B:
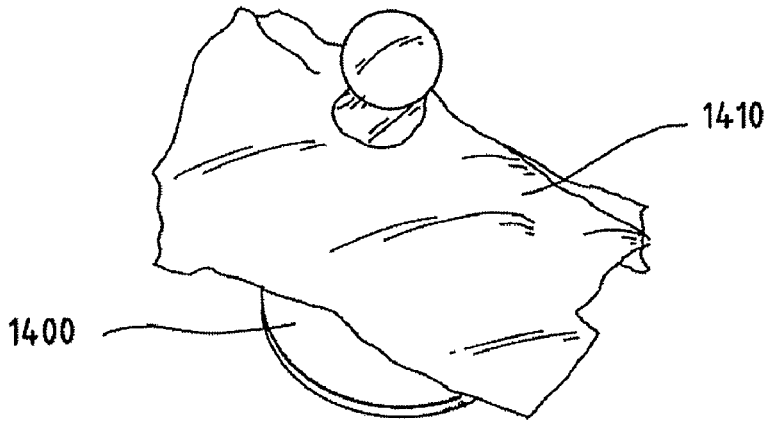
FIG. 14B depicts the film being stretched over the stretching form in accordance with one embodiment of the present invention.
Figure 14C:
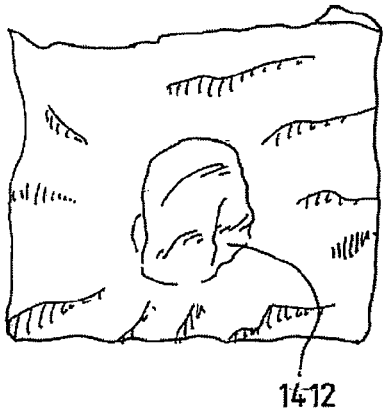
FIG. 14C depicts the stretched film removed from the stretching form in accordance with one embodiment of the present invention.
Figure 14D:
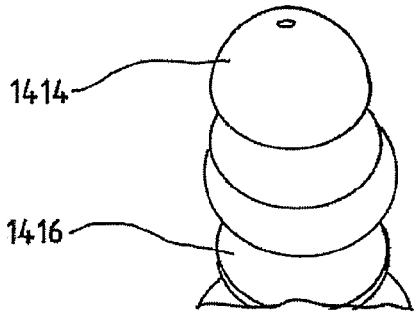
FIG. 14D depicts one example of an ear tip similar to that illustrated in FIGS. 2A-2G prior to applying an acoustically transparent barrier in accordance with one embodiment of the present invention.

FIGS. 14A-14J illustrate another method for forming a communication device in accordance with embodiments of the present invention. FIG. 14A depicts a stretching form 1400 and barrier film 1410 material for application to an acoustic device. FIG. 14B depicts the film 1410 being stretched over the stretching form 1400, thinning the film. FIG. 14C depicts the stretched film 1412 removed from the stretching form 1400 and having a suitable thickness. FIG. 14D depicts one example of an ear tip 1414 (similar to that illustrated in FIGS. 2A-2F) mounted on a fixture 1416 and prior to applying an acoustically transparent barrier.

Figure 14E:
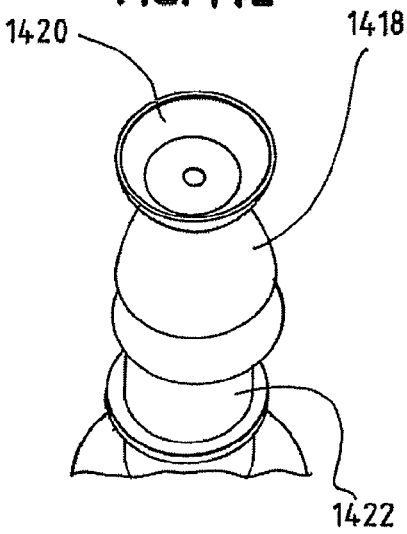
FIG. 14E depicts an example of the ear tip similar to that illustrated in FIG. 14D with the end flange turned upwards in accordance with one embodiment of the present invention.
Figure 14F:
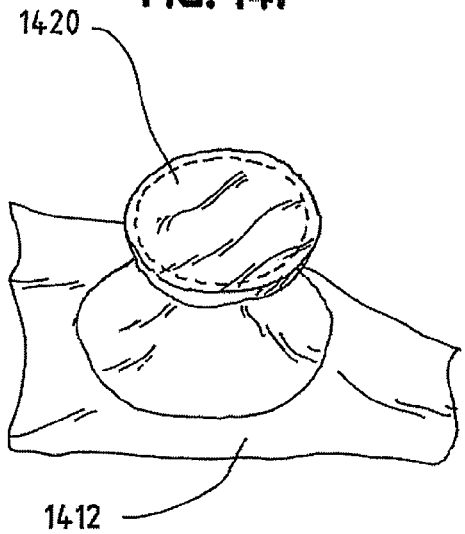
FIG. 14F depicts the flipped up end of the ear tip of FIG. 14E having the stretched film depicted in FIG. 14C roughly applied thereto in accordance with one embodiment of the present invention.
Figure 14G:
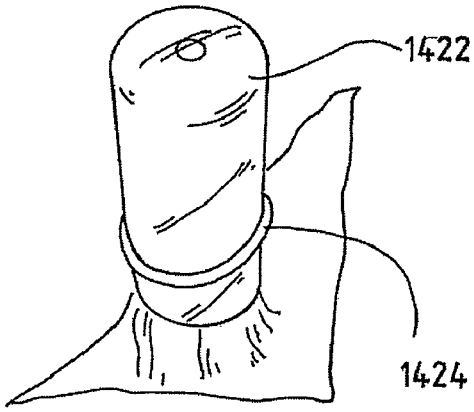
FIG. 14G depicts an elastic band attachment fixture having a mechanical device (an elastic fastener for example) adapted to fix the stretched film to the ear tip of FIG. 14E in accordance with one embodiment of the present invention.
Figure 14H:
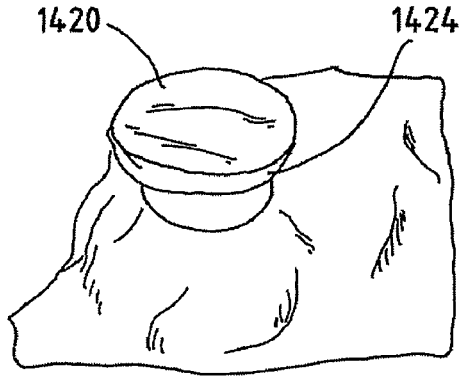
FIG. 14H depicts the flipped up end of the ear tip of FIG. 14F with stretched film having the elastic fastener of FIG. 14G attached thereto in connection with one embodiment of the present invention.
Figure 14I:
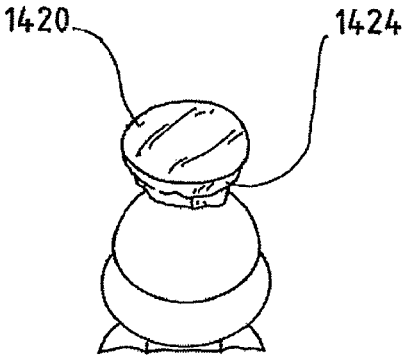
FIG. 14I depicts the ear tip of FIG. 14H with the excess film removed in accordance with one embodiment of the present invention.
Figure 14J:
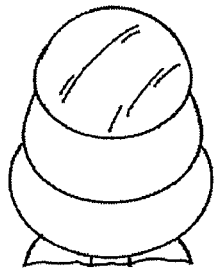
FIG. 14J depicts the ear tip of FIG. 14I with the end flange turned down in accordance with one embodiment of the present invention.

FIG. 14E depicts an example of the ear tip 1418 similar to that illustrated in FIG. 14D with the end flange 1420 turned upwards or away from the base 1422 of the earpiece. FIG. 14F depicts the flipped up end 1420 of the ear tip of FIG. 14E having the stretched film 1412 depicted in FIG. 14C roughly applied thereto. FIG. 14G depicts an elastic band attachment fixture having a mechanical device (an elastic fastener for example) thereon and adapted to fix the stretched film to the ear tip of FIG. 14E in accordance with one embodiment of the present invention. FIG. 14H depicts the flipped up end of the ear tip of FIG. 14F with stretched film having the elastic fastener of FIG. 14G attached thereto. FIG. 14I depicts the ear tip of FIG. 14H with the excess film removed. FIG. 14J depicts the ear tip of FIG. 14I with the end flange turned down or returned to its original position, forming the communication device.

In another embodiment, the method for forming a communication device in accordance with embodiments of the present invention comprises stretching a larger piece of material over a larger heated round form. Stretching the material over the hot round form stabilizes the material up to a desired maximum high temperature (63° C. for example). In addition, once the material has been stretched over a large form, a plurality of individual circular patterns can be punched out for further processing.

Figure 15:
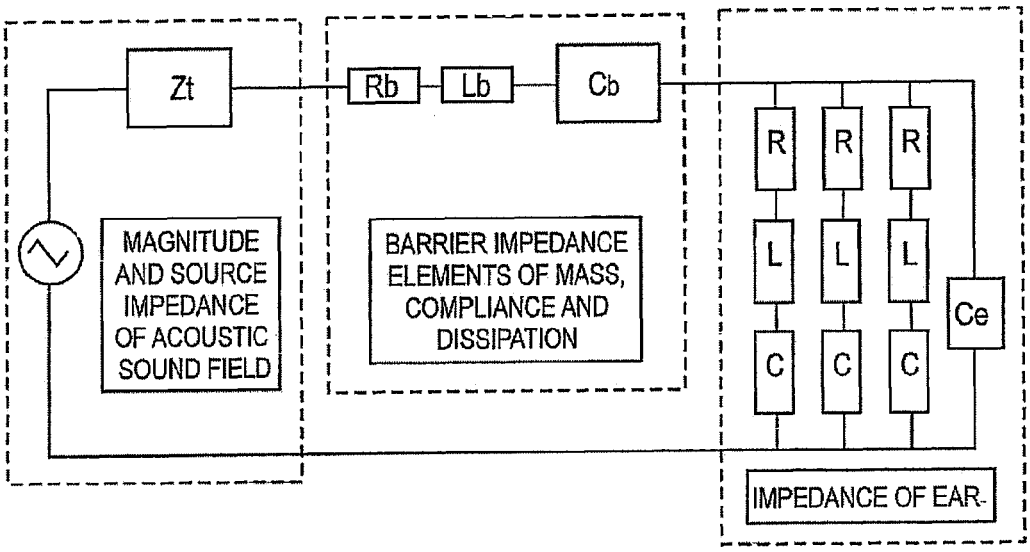
FIG. 15 depicts an analog equivalent circuit illustrating the relationship among the impedance of a barrier, a receiver sound source and a human ear in accordance with one embodiment of the present invention.
Figure 16:
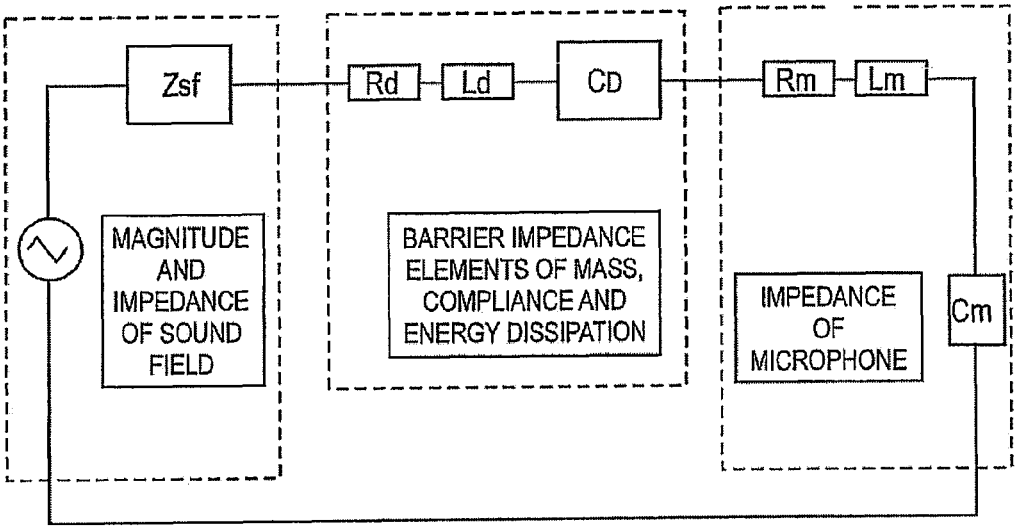
FIG. 16 depicts an analog equivalent circuit illustrating the relationship among the impedance of a barrier, a sound field and a microphone in accordance with one embodiment of the present invention.

FIGS. 15 and 16 depict analog equivalent circuits. More specifically, the illustrated equivalent analog circuit of FIG. 15 depicts the relationship among the impedance of a barrier, a receiver sound source and a human ear in accordance with one embodiment of the present invention. The impedance of the receiver type barrier diaphragm is represented in FIG. 15 in series with the complex impedance of the occluded human ear canal, which may be approximated by a volume of about 0.5 cubic centimeters. The sound source is a receiver such as found in hearing aids and various forms of insert earphones. In normal operation, a specific voltage would appear across the impedance representing the ear canal and thus represents the normal or expected behavior of the transducer. If a barrier is introduced, having an equivalent series impedance as indicated, the voltage developed across the ear canal impedance may be altered, depending upon the value of the impedance. It is contemplated that suitable barriers comprise film type materials having an impedance that is small in relationship to the canal impedance.

The analog equivalent circuit of FIG. 16 illustrates the relationship among the impedance of a barrier, a sound filed and a microphone in accordance with one embodiment of the present invention. FIG. 16 illustrates the situation for microphone barriers, where it has been generally observed that higher impedance barriers (when compared to those used with the insert earphones) are possible due to the comparatively higher impedance of microphone diaphragms relative to the impedance of a typical ear canal.

Figure 17:
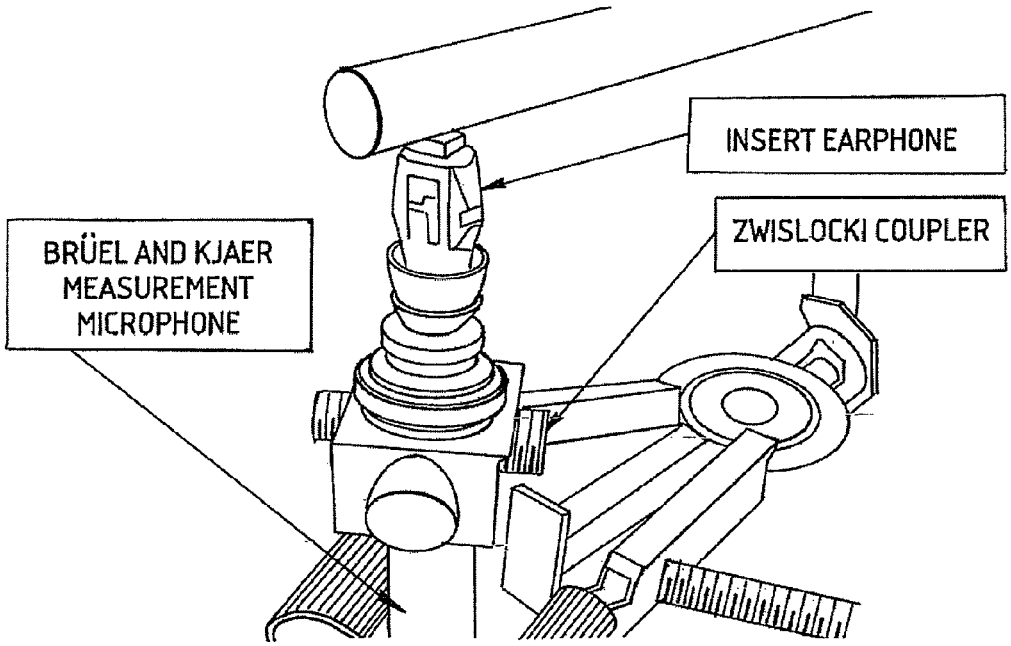
FIG. 17 depicts a measurement set up illustrating an insert earphone type receiver driving a Zwislocki coupler in accordance with the present invention.

Confirmation of receiver barrier performance may be determined through the use an acoustic coupler and measurement microphone known to simulate the impedance of the typical human ear. Such a coupler, known as a Zwislocki Coupler, is illustrated in FIG. 17. Confirmation of suitable performance may be obtained by measuring an acoustice device, such as a high fidelity insert earphone for example, using this arrangement where a comparison is made between the accoustic device with and without the prospective barrier. The performance of microphone barriers may be measured in a sound field representative of the use of the microphone. In such cases comparative curves may be obtained with and without the barrier menbrane. Examples of such measurements are illustrated in FIGS. 10C and 11C for two different omnidirectional electric condenser microphones. In one embodiment, the measurements depicted in FIGS. 10C and 11C are generated using wide range speakers in combination with the microphones described above, both with and without barriers.

Further, membrane materials found suitable for these application include Linear Low Density Polyethylene ("LLDPE") blends in film form for example with an initial thickness of about 0.00035 to about 0.00055 inches.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A debris barrier used with an acoustic device, the barrier comprising a non-rigid, compliant film configured to be movable so as to provide re-radiation of sound from the acoustic device when coupled with the acoustic device, the barrier having a non-tensioned active compliant area with a diameter of about 2.5 mm or greater when coupled with the acoustic device, and the film being formed of a non-porous material.

2. The barrier of claim 1 having a diameter of about 3.0 mm or less.

3. The barrier of claim 1, wherein the film has a thickness of about 0.0003 inches or less.

4. The barrier of claim 1 wherein said material is of a low mass.

5. The barrier of claim 1 wherein said material has low stiffness.

6. The barrier of claim 1 wherein said material is chemically resistant.

7. The barrier of claim 1 wherein said material has a high elongation and high impact strength.

8. The barrier of claim 1 wherein said material has a low sensitivity to temperature change.

9. The barrier of claim 1 wherein said material comprises a polyethylene blend.

10. The barrier of claim 1, wherein the barrier is adapted to be protected from static pressure forces when coupled with the acoustic device by including a leakage path in the barrier.

11. A debris barrier used with an acoustic device, the barrier comprising a non-rigid, compliant film configured to be movable so as to provide re-radiation of sound from the acoustic device when coupled to the acoustic device, the barrier having a non-tensioned active compliant area when coupled with the acoustic device, the barrier having a diameter of about 3.0 mm or less, and the film being formed of a non-porous material.

12. The barrier of claim 11, wherein the film has a thickness of about 0.0003 inches or less.

13. The barrier of claim 11 having an active compliant area with a diameter of about 2.5 mm or greater when coupled with the acoustic device.

14. The barrier of claim 11 wherein said material has a low mass and low stiffness.

15. The barrier of claim 11 wherein said material is insensitive to temperature change.

16. The barrier of claim 11 wherein said material comprises a polyethylene blend.

17. The barrier of claim 11, wherein the barrier is adapted to be protected from static pressure forces when coupled with the acoustic device by including a leakage path in the barrier.

18. A communication device adapted to block debris comprising:

an acoustic device;

a non-rigid, compliant debris barrier configured to be movable so as to provide re-radiation of sound from the acoustic device when coupled to said acoustic device, the barrier having a non-tensioned active compliant area when coupled with the acoustic device; and an attachment device configured to be removably inserted into a port of the acoustic device, wherein the debris barrier is coupled to the acoustic device using the attachment device, and wherein the attachment device includes a first end comprising an opening of a first diameter and a second end comprising a second opening of a second diameter, the second diameter being smaller than the first diameter.

19. The communication device of claim 18 wherein said barrier comprises a non-porous material about 0.0003 inches thick or less.

20. The communication device of claim 18, wherein said barrier has a diameter of about 3.0 mm or less.

21. The communication device of claim 18, wherein said barrier has an active compliant area with a diameter of about 2.5 mm or greater when coupled with the acoustic device.

22. The communication device of claim 18 wherein said barrier is fixed to said attachment device.

23. The communication device of claim 18 wherein said barrier is adapted to be protected from static pressure forces when coupled with the acoustic device by including a leakage path in the barrier.

24. The communication device of claim 22, wherein said barrier is fixed to said attachment device using a heat process.

25. The communication device of claim 22 wherein said barrier is fixed to said attachment device using an adhesive or mechanical process.

26. The communication device of claim 18 wherein said barrier is selected from a material having a low mass, low stiffness, a high elongation and high impact strength and is chemical resistant.

27. The communication device of claim 26 wherein said material comprises a polyethylene blend.

28. The communication device of claim 27 wherein said polyethylene blend comprises an organometallic complex.

29. A method of protecting an acoustic device from debris comprising:

forming a debris barrier configured to be movable so as to provide re-radiation of sound from the acoustic device when coupled to the acoustic device, the barrier comprising a non-rigid, compliant film being formed of a non-porous material, the barrier having a non-tensioned active compliant area when coupled with the acoustic device; and affixing said barrier to an attachment device adapted to be used with the acoustic device, wherein the attachment device is configured to be removably inserted into a port of the acoustic device, and wherein the attachment device includes a first end comprising an opening of a first diameter and a second end comprising a second opening of a second diameter, the second diameter being smaller than the first diameter.

30. The method of claim 29 wherein said material has a low mass, low stiffness, a high elongation and high impact strength, is chemical resistant and is insensitive to temperature change.

31. The method of claim 29 wherein the barrier is adapted to be protected from static pressure forces when coupled with the acoustic device by including a leakage path in the barrier.

32. A method of forming an acoustic device having a debris barrier, the method comprising:

forming a non-rigid and compliant film;

coupling said film to an attachment device such that the film includes a non-tensioned active compliant area; and inserting the attachment device into a port of the acoustic device such that the film is movable so as to provide re-radiation of sound from the acoustic device, wherein the film forms a debris barrier, wherein the attachment device is configured to be removably inserted into the port of the acoustic device, and wherein the attachment device includes a first end comprising an opening of a first diameter and a second end comprising a second opening of a second diameter, the second diameter being smaller than the first diameter.

33. The method of claim 32 comprising forming said film of a material having a thickness of about 0.0003 inches or less.

34. The method of claim 32, wherein the barrier is adapted to be protected from static pressure forces when coupled with the acoustic device by including a leakage path in the barrier.

35. The method of claim 32, wherein said material comprises a polyethylene blend.

36. A debris barrier used with an acoustic device, the barrier comprising a non-rigid, compliant film with a thickness of about 0.0003 inches or less and formed from a non-porous material, the film configured to be movable so as to provide re-radiation of sound from the acoustic device when attached to the acoustic device, the film having a non-tensioned active compliant area when coupled with the acoustic device.

37. The barrier of claim 36 wherein the film has a maximum attenuation of approximately 2 dB or less over a frequency range of approximately 100 Hz to 10,000 Hz and adds less than 0.5% THD for sound pressure levels up to about 115 dB SPL.

38. The barrier of claim 36 wherein the barrier is adapted to be protected from static pressure forces when coupled with the acoustic device by including a leakage path in the barrier.

39. The barrier of claim 36 having a diameter of about 3.0 mm or less and an active compliant area with a diameter of about 2.5 mm or greater when coupled with the acoustic device.

40. A non-rigid, compliant debris barrier configured to be movable so as to provide re-radiation of sound from an acoustic device when coupled with the acoustic device, the debris barrier having a non-tensioned active compliant area when coupled with the acoustic device, wherein the debris barrier is coupled to the acoustic device using an attachment device configured to be removably inserted into a port of the acoustic device, and wherein the attachment device includes a first end comprising an opening of a first diameter and a second end comprising a second opening of a second diameter, the second diameter being smaller than the first diameter.

41. The barrier of claim 40, wherein the barrier comprises a non-porous material.

42. The barrier of claim 41, wherein the barrier is adapted to be protected from static pressure forces when coupled with the acoustic device by including a leakage path in the barrier.

43. The barrier of claim 40, wherein the first diameter is about 2.5 mm or less.

44. The barrier of claim 40, wherein the attachment device includes a mounting surface comprising a lip that extends from the attachment device.

45. The communication device of claim 18, wherein the first diameter is about 2.5 mm or less.

46. The communication device of claim 18, wherein the attachment device includes a mounting surface comprising a lip that extends from the attachment device.

* * * * *